US008280555B2

(12) United States Patent
Masui et al.

(10) Patent No.: US 8,280,555 B2
(45) Date of Patent: Oct. 2, 2012

(54) AIR CONDITIONING SYSTEM

(75) Inventors: Hirotaka Masui, Tokyo (JP); Hidesuke Hayakawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 432 days.

(21) Appl. No.: 12/304,338

(22) PCT Filed: Jul. 13, 2006

(86) PCT No.: PCT/JP2006/313956

§ 371 (c)(1),
(2), (4) Date: Dec. 11, 2008

(87) PCT Pub. No.: WO2008/007433

PCT Pub. Date: Jan. 17, 2008

(65) Prior Publication Data

US 2009/0281667 A1 Nov. 12, 2009

(51) Int. Cl.
*G05B 13/00* (2006.01)

(52) U.S. Cl. ..... 700/276; 700/278

(58) Field of Classification Search ..... 700/276–278
See application file for complete search history.

(56) References Cited

U.S. PATENT DOCUMENTS

| | | | | |
|---|---|---|---|---|
| 4,523,714 | A * | 6/1985 | Isermann | 236/46 R |
| 6,909,921 | B1 * | 6/2005 | Bilger | 700/19 |
| 7,058,477 | B1 * | 6/2006 | Rosen | 700/277 |
| 7,336,168 | B2 * | 2/2008 | Kates | 340/539.18 |
| 7,360,717 | B2 * | 4/2008 | Shah | 236/46 R |
| 7,847,681 | B2 * | 12/2010 | Singhal et al. | 340/514 |
| 2003/0216837 | A1 * | 11/2003 | Reich et al. | 700/276 |
| 2004/0263351 | A1 * | 12/2004 | Joy et al. | 340/870.01 |
| 2005/0288824 | A1 * | 12/2005 | Fisher | 700/277 |
| 2006/0117769 | A1 * | 6/2006 | Helt et al. | 62/161 |
| 2006/0142880 | A1 * | 6/2006 | Deen et al. | 700/19 |
| 2007/0045429 | A1 * | 3/2007 | Chapman et al. | 236/46 C |
| 2007/0227168 | A1 * | 10/2007 | Simmons | 62/229 |
| 2007/0271006 | A1 * | 11/2007 | Golden et al. | 700/295 |

FOREIGN PATENT DOCUMENTS

| | | | |
|---|---|---|---|
| JP | 7-318144 | A | 12/1995 |
| JP | 2005-16846 | A | 1/2005 |
| JP | 2006-118837 | A | 5/2006 |

OTHER PUBLICATIONS

International Search Report (PCT/ISA/210).
Office Action issued in the corresponding Chinese Patent Application No. 2006800546565 dated Dec. 11, 2009 (and English translation of the Main Body of the Chinese Office Action).

* cited by examiner

*Primary Examiner* — Mohammad Ali
*Assistant Examiner* — Nathan Laughlin
(74) *Attorney, Agent, or Firm* — Posz Law Group, PLC

(57) ABSTRACT

Even at spots, such as a window side and the back side of a room, where air conditioning loads are different from each other, comfortable air conditioning is obtained at low cost using a common air conditioning unit. One indoor apparatus and wireless transceiver having a ZigBee-compliant transmission device are installed in the room. Sensor units having temperature/humidity sensors and ZigBee-compliant wireless transceivers are installed at plural indoor spots where the air conditioning loads are different from each other. A controller in the indoor-apparatus receives sensor information (temperature/humidity information) via the wireless transceivers from the sensor units, and computes a weight average based on the sensor information and weight values that are pre-stored in the storing devices and that correspond to the sensor units. Using the computed value as a control value, the controller controls an air conditioning unit.

9 Claims, 20 Drawing Sheets

$$\text{CONTROL VALUE} = \frac{\Sigma\ (i=1\sim n)\ Wi^{k} \times Si^{m}}{\Sigma\ (i=1\sim n)\ Wi^{k}}$$

WHERE Wi INDICATES WEIGHT i VALUE, Si INDICATES SENSOR i VALUE °C, AND k AND m INDICATES MULTIPLIERS

WHERE Wi INDICATES WEIGHT i VALUE, Si INDICATES SENSOR i VALUE °C, k AND m INDICATE MULTIPLIERS, AND n = 2

WHERE Wi INDICATES WEIGHT i VALUE, Si INDICATES SENSOR i VALUE °C, k AND m INDICATE MULTIPLIERS, AND n = 2

AIR CONDITIONING SYSTEM

TECHNICAL FIELD

The present invention relates to an air conditioning system used for room-temperature control and so on in a building.

BACKGROUND ART

Conventionally, methods as described below are known as air conditioning control methods.

For example, a receiver receives sensor identification information and sensor values from air-conditioning wireless sensors installed in respective rooms and relays them to a control unit. Partition information (an association table) of the rooms is pre-input to the control unit, and the control unit determines control data from the sensor value of the air-conditioning wireless sensor corresponding to an air conditioning unit and transmits the control data to the air conditioning unit. Based on the control data from the control unit, the air conditioning unit controls the air conditioning unit. When the layout is changed, it is known that only making changes to the partition information (the association table) is sufficient (e.g., refer to Patent Document 1).

In another conventional example, a single or multiple antennas are installed on the ceiling of each room, and when a wireless remote controller having a built-in room-temperature sensor is operated, the position where the wireless remote controller is operated is detected and equipment to be controlled corresponding to the detected position is controlled. When plural wireless remote controllers are operated in the same space, the equipment to be controlled is controlled based on the average value of set information, not the average value of room temperatures that are sensor values (e.g., refer to Patent Document 2).

Also, a commonly used air conditioner has a built-in room-temperature sensor and is controlled so that an intake air temperature matches a set temperature.

Patent Document 1: Japanese Unexamined Patent Application Publication No. 07-318144 (See FIG. 1, paragraph 0012 of Patent Document 1)

Patent Document 2: Japanese Unexamined Patent Application Publication No. 2005-016846 (See FIG. 2, paragraph 0033 of Patent Document 2)

DISCLOSURE OF INVENTION

Problems to be Solved by the Invention

The conventional air conditioning system performs control by detecting an intake air temperature of the air conditioner by using the room-temperature sensor. Thus, since a window side affected by low-temperature outside air in winter and direct sunlight in summer, a room back side area where it is hot even in winter because of an influence of heat generated by a personal computer and a user, a foot side area where it is cold even in summer because of an influence of heavy low-temperature air and radiation from the floor, and so on are far apart from the intake of the air conditioner, it is difficult to detect correct temperatures at those positions. In the case of a ceiling-installation-type air conditioner, while the air temperature at the ceiling portion is detected by the room-temperature sensor, the air temperature at the ceiling portion is detected at a higher temperature than the air temperate at the position of the user, which makes it difficult to perform comfortable control that meets the user's request.

In the conventional example shown in Patent Document 1, wireless sensors that are free in installation positions are used, and thus, temperatures at the positions of the window side, the room back side, the floor, and the person can be detected, but the temperature at only one spot is detected. Thus, when the wireless sensor is installed at the window side, there are problems in that the air conditioning unit operates at full power because of an influence of cold temperature at the window, and the back side of the room, other than the window side, becomes hot and uncomfortable, while the window side is comfortable.

In the conventional example shown in Patent Document 2, when plural users operate the built-in wireless remote controllers in the same space, respectively, the average value of set information, not the average value of room temperatures that are sensor values, is used to control the equipment to be controlled. Thus, operations for comfortable set temperature are not necessarily performed. For example, a user at the cold window side may perform an operation for a maxim set temperature and a user at the back side of the room may perform an operation for a minimum set temperature. Thus, comfort cannot be obtained by the average set temperature. There is also a problem in that the cost for installing an antenna for detecting the positions of the wireless sensors is high.

The wireless sensors and the remote controllers in Patent Documents 1 and 2 use batteries as their power sources. Thus, they require periodic battery replacement which is a troublesome work, and the temperature cannot be detected if the battery replacement is neglected.

The present invention has been made to overcome problems as described above, and a main object of the present invention is to provide a comfortable air conditioning at spots, such as a window side and the back side of a room, where air-conditioning loads are different from each other, at low cost by using a common air conditioning unit.

Means for Solving the Problems

An air conditioning system according to the present invention comprises: plural sensor units each having a sensor for detecting temperatures and/or humidities of space to be air-conditioned and outputting the temperatures and/or the humidities as sensor values, unit-identification setting means for generating identification information for identifying the corresponding sensor units, and first wireless transmitting means for modulating the identification information generated by the unit-identification setting means and the sensor values outputted by the sensors and transmitting the modulated identification information and sensor values; and an air conditioning unit having second wireless transmitting means for receiving the identification information and the sensor values from the first wireless transmitting means and demodulating the identification information and the sensor values, and controlling means for adjusting the temperatures and/or the humidities of the space to be air-conditioned, based on a weighted average value tinged with a weight values, relating to the sensor values of the sensor units identified based on the identification information demodulated by the second wireless transmitting means, the sensor values being demodulated by the second wireless transmitting means.

Advantages

According to the present invention, the controlling means in the air-conditioning unit adjusts the temperature, the humidity, and/or the like of space to be air-conditioned, based on the sensor information from the plural sensors. Thus, it is possible to provide a comfortable air conditioning by using a common air conditioning unit.

BEST MODES FOR CARRYING OUT THE INVENTION

First Embodiment

Figures 1, 2:
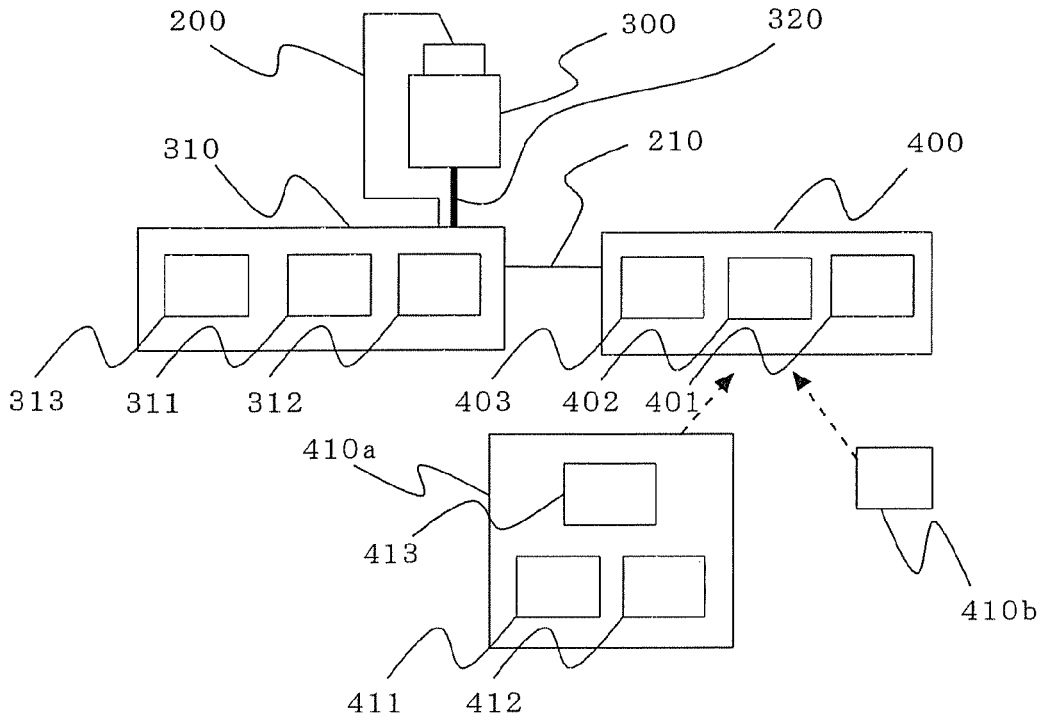
FIG. 1 is a block diagram showing the configuration of an air conditioning system in a first embodiment of the present invention.
FIG. 2 is an illustration showing an arithmetic expression used in each embodiment of the present invention.

FIG. 1 is a block diagram showing the configuration of an air conditioning system according to a first embodiment of the present invention, and FIG. 2 is an illustration showing an arithmetic expression for controlling the system.

In FIG. 1, an outdoor apparatus 300 and an indoor apparatus 310 are connected with each other through a refrigerant pipe 320 and a transmission line 200 to constitute an air conditioning unit. A transmission unit 400 includes wireless transmitting means 401 in compliance with a ZigBee (trademark) (IEEE 802.15.4) standard, controlling means 402 for performing protocol conversion, and transmitting means 403 for communicating with the indoor apparatus 310, and is connected to the indoor apparatus 310 through a transmission-dedicated line 210. The indoor apparatus 310 includes controlling means 311 for calculating a weighted average and for controlling operation based on the result of the calculation and transmitting means 312 for performing information communication with the transmission unit 400. The controlling means 311 and the transmitting means 312 are provided as standard equipment for the indoor apparatus 310. Sensor units 410*a* and 410*b* include temperature sensors 411, unit-identification-information setting means 412 for setting identification information of the corresponding sensor units, and wireless transmitting means 413 in compliance with the ZigBee standard for performing transmission/reception to/from the wireless transmitting means 401 in the transmission unit 400. Although the term "transmitting means" is used throughout the specification, one skilled in the art will readily understand that the term "transceiving means" or "transceiver" may also be interchangeably used to describe any device that is capable of performing such transmission/reception to/from another like device.

In embodiments including this first embodiment, the number of sensor units is not limited to 2 and may be more. The wireless transmission is not limited to one that utilizes ZigBee and may be one based on another system, such as Bluetooth or a UWB (Universal Wide Band).

Figure 3:
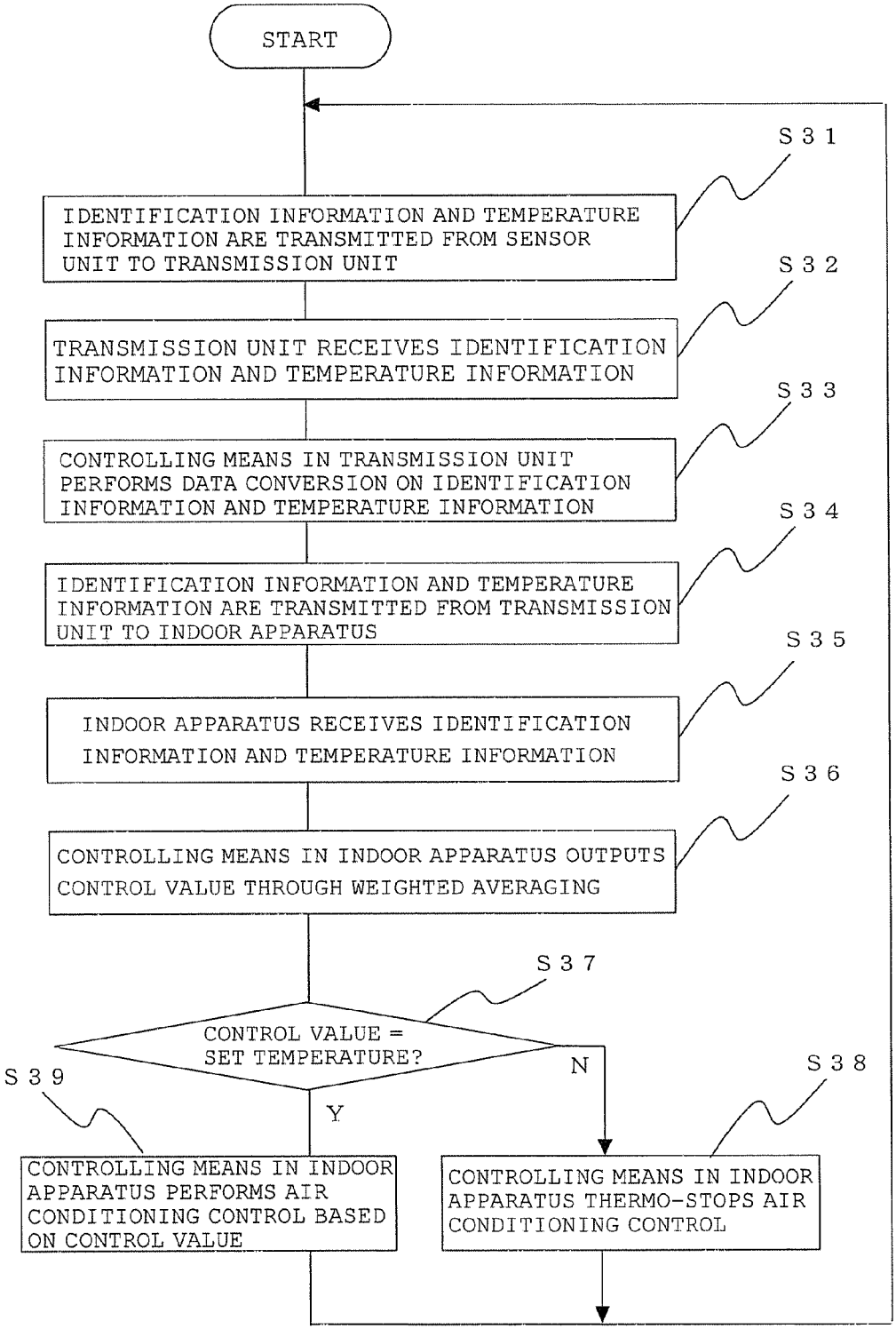
FIG. 3 is a flowchart showing the operation of the first embodiment of the present invention.

FIG. 3 is a flowchart showing the operation of this first embodiment. Next, the operation of the first embodiment will be described with reference to FIGS. 1 to 3.

Each of the sensor units 410*a* and 410*b* includes the unit-identification-information setting means 412 for setting identification information of the sensor unit. The unit-identification-information setting means 412 can be implemented by, for example, a DIP switch. In this case, a user sets different values for the DIP switches by manual operation to thereby assign unique addresses to the sensor units 410*a* and 410*b*, respectively. The unit-identification-information setting means 412 can also be implemented by plural jumper lines and cutting portions of the jumper lines to be different from each other. Alternatively, the unit-identification-information setting means 412 can also be implemented by directly writing different addresses for the respective sensor units to non-volatile storing means, such as a ROM, by using software. The sensor-unit identification information set by the above-described means can be transmitted to external space via the ZigBee-compliant wireless transmitting means 413, while power is supplied to the sensor units. The sensor units 410*a* and 410*b* also include temperature sensors 411, such as thermistors, for measuring temperatures. The temperature detected by the temperature sensor 411 can be transmitted to the external space via the ZigBee-compliant wireless transmitting means 413.

In the sensor units 410*a* and 410*b*, the ZigBee-compliant wireless transmitting means 413 modulates the sensor-unit identification information set by the unit-identification-information setting means 412 and the temperature information measured by the temperature sensor 411 and then transmits the modulated information to space (step S31). The information is transmitted to the transmission unit 400 by propagating in the space. In the transmission unit 400, the ZigBee-compliant wireless transmitting means 401 receives the information and demodulates the information (step S32). The controlling means 402 converts the demodulated identification information and temperature information into information for the indoor apparatus (step S33) and then transmits the converted information to the indoor apparatus 310 via the transmitting means 403 and the transmission-dedicated line 210 (step S34).

In the indoor apparatus 310, when the controlling means 311 receives the identification information and the temperature information via the transmission-dedicated line 210 and the transmitting means 312 (step S35), the controlling means 311 calculates a weighted average based on the kth power (k is an arbitrary value of 1 to n) of weight i values Wi (i=1 to n) that are pre-stored in the storing means 313 and that correspond to the sensor units 410*a* and 410*b* and the mth power (m is an arbitrary value of 1 to n) of sensor i values Si (i=1 to n) that are the temperature information of the sensors, in accordance with the expression in FIG. 2, and sets the result of the calculation as a control value C (step S36). The controlling means 311 then compares the control value C with a set temperature (step S37). When they do not match each other, the controlling means 311 in the indoor apparatus 310 controls the operation of the air conditioning unit based on the control value (step S38), and the process returns to step S31. That is, the controlling means 311 performs capacity control on a compressor of the air conditioning unit based on the control value by using, for example, an inverter, and an air-conditioning cycle executes an air conditioning operation based thereon. When the control value C and the set temperature match each other in the comparison in step S37, the controlling means 311 thermo-stops the air-conditioning control (step S39) and the process return to step S31. That is, the controlling means 311 in the indoor apparatus 310 controls the operation of the air conditioning unit until the control value matches the set temperature.

In the above-described weighted averaging, the weight i value means the ith weight and the sensor i value means the ith sensor value.

Specifically, in accordance with the expression in FIG. 2, for example, for k=m=1, the controlling means 311 computes a weighted average of the first power of the weight 1 value (W1) for the sensor unit 410*a* and the first power of the weight 2 value (W2) for the sensor unit 410*b*, which are pre-stored in the storing means 313, and the first power of the sensor 1 value (S1) and the first power of the sensor 2 value (S2) which are respective temperature information for the corresponding sensors, sets the result of the calculation as the control value C, and controls the operation of the air conditioning unit until the control value matches the set temperature.

Figure 4:
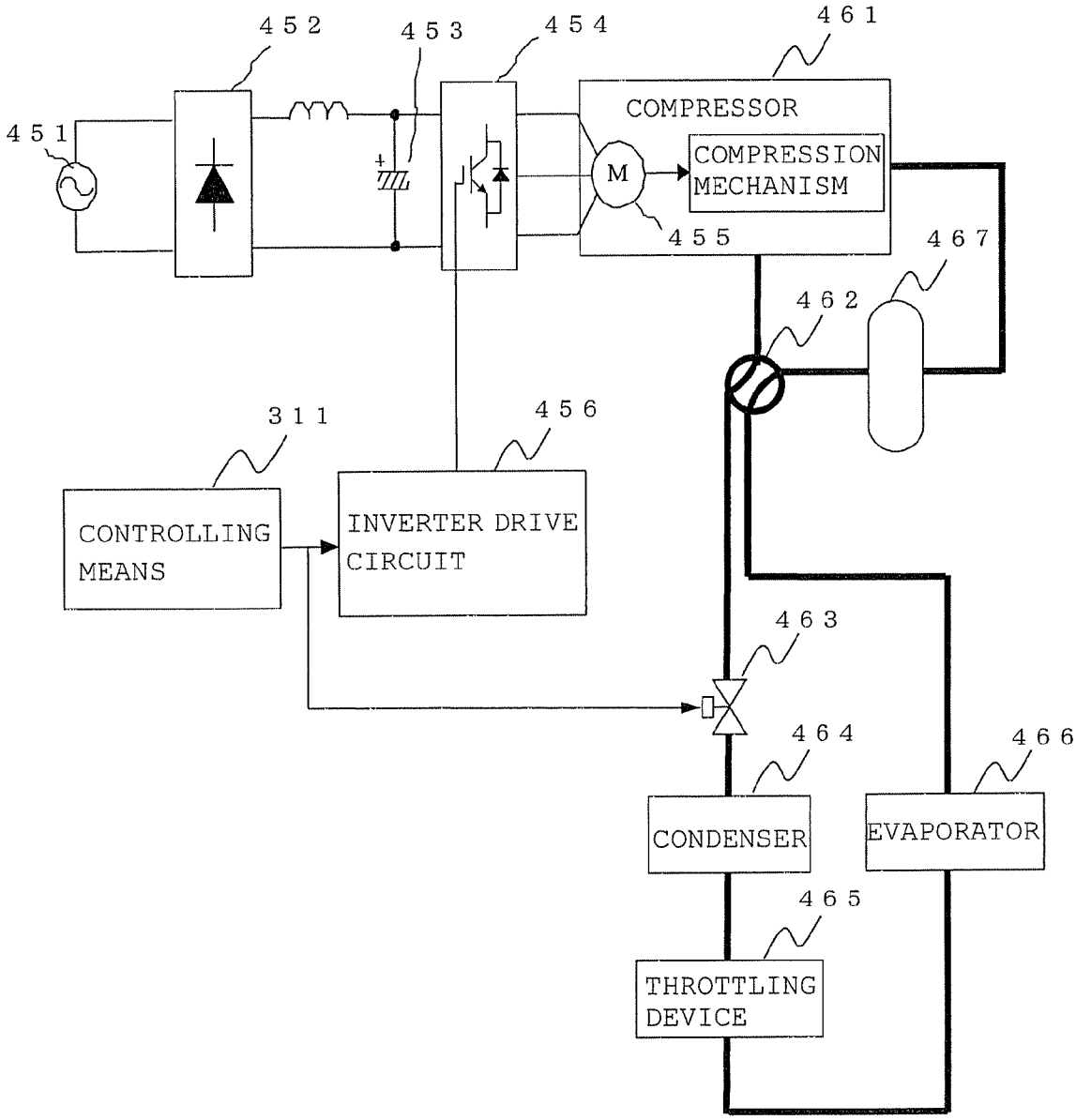
FIG. 4 is a configuration diagram showing an inverter circuit of the air conditioning system in the first embodiment of the present invention.

FIG. 4 is a circuit diagram showing the configuration of the inverter-driven air conditioning system in the first embodiment of the present invention. As shown in FIG. 4, the air conditioning system is constituted by a refrigerant cycle and an inverter system. The refrigerant cycle includes a compressor 461, a four-way valve 462, a refrigerant flow control valve 463, a condenser 464, a throttling device 465, an evaporator 466, and an accumulator 467. The inverter system has an alternating current power source 451 for performing capacity control on the compressor 461, a rectifier circuit 452, a smoothing capacitor 453, an inverter 454, a compressor motor 455, and an inverter drive circuit 456. The controlling means 311 controls the frequency of the alternating current power source for driving the compressor motor 455, by supplying the control value, obtained by the weighted averaging, to the above-mentioned inverter drive circuit 456 to perform PWM control on the inverter 454. Also, the controlling means 311 controls the flow of refrigerant so that it has a desired value, by supplying, as an instruction value, the above-described control valve to the refrigerant flow control valve 463 to adjust the degree of the opening/closing of the refrigerant flow control valve. This allows for an optimum air conditioning operation corresponding to the control value from the controlling means 311.

As described above, according to the air conditioning system of the present invention, the transmission unit having the wireless transmitting means is connected to the air conditioning unit, and the weighted average value in which the sensor information from the plural sensor units having the wireless transmitting means is tinged with weight values corresponding to use situations (such as the installation place, season, time frame, outside-air temperature, and illumination (direct sunlight and light-OFF)) is used as the control value to control the operation of the air conditioning unit. Thus, it is possible to provide a comfortable air conditioning even at spots, such as a window side and the back of the room, where air conditioning loads are different from each other.

The air conditioning system does not require a special control device for compressively managing indoor apparatuses, can be configured at low cost since the indoor apparatus itself performs the determination, and can also be applied to a small-scale air conditioning system.

Second Embodiment

While the above-described first embodiment is configured such that the indoor apparatus 310 itself performs the determination without addition of a special control device, a description in this second embodiment will be given of an embodiment in which a setting unit having determining means for computing weighted values is added.

Figure 5:
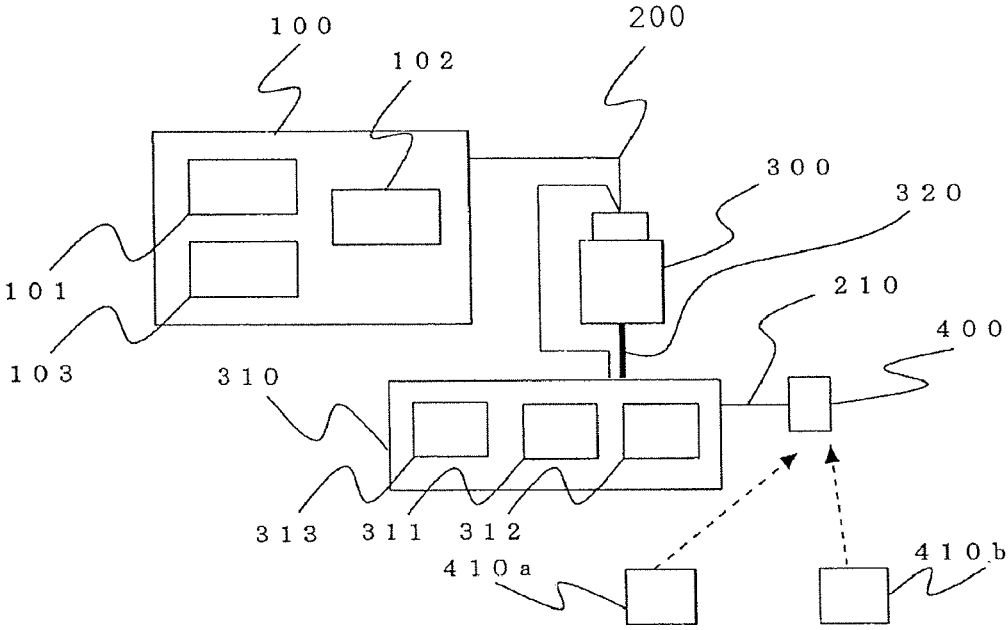
FIG. 5 is a block diagram showing the configuration of an air conditioning system in a second embodiment of the present invention.

FIG. 5 is a block diagram showing the configuration of an air conditioning system according to the second embodiment of the present invention. In FIG. 5, the same reference numerals as those in FIG. 1 denote the same or corresponding portions. The configuration in the second embodiment is the same as that in the first embodiment, except that a setting unit 100 for exchanging information with the indoor apparatus 310 via the transmission line 200 is added. The configurations of the transmission unit 400 and the sensor units 410*a* and 410*b* are the same as those in FIG. 1. The setting unit 100 includes determining means 101 for computing a weighted value for each of the sensor units 410*a* and 410*b*, transmitting means 102 for communicating with the transmitting means 312 in the indoor apparatus 310, and storing means 103 for storing schedule data.

Next, the operation of the second embodiment will be described with reference to FIG. 5.

The determining means 101 in the setting unit 100 is equipped with a yearly-schedule function. The schedule function is realized by, for example, incorporating a microcomputer into the determining means 101, storing software having a schedule function in the storing means 103, and causing the microcomputer to execute the software having the schedule function. When preset time is reached every day, the determining means 101 uses the schedule function to perform measurement multiple times at intervals of few minutes for each of the sensors provided at the window side and the back side of the room. Average values obtained from the measurement are stored, for each sensor, in the storing means 103 as measurement data. The data are accumulated every year. Subsequently, for calculation of the weight, weighted values are computed using the measurement data for the past several years which are accumulated in the storing means 103 for each sensor. Examples of a computing method include: a method in which an average value of measurement data for each season in the past several years for each sensor is used as a weight value for each season in this year (e.g., for summer, an average value of measurement data for everyday in three months in the summer in one year is calculated and the calculated average value is stored in the storing means 103 as an average value for the single summer, and average values for the summers in the past several years are similarly stored in the storing means. Then, the average value of the measurement data for summer is obtained by retrieving the average values for the summers in predetermined past years (e.g., in the past 10 years) and calculating an average thereof. The same applies to the other seasons), a method in which a result obtained by adding a value that varies depending on the season to an average value of measurement data obtained every three months is used as a weight; and a method in which a result obtained by multiplying an average value of measurement data obtained every three months by a value that varies depending on the season is used as the weight. Also, examples include a method in which a weighted value is calculated based on an average value of temperature information of weather forecast in this region for the next one week. The value that varies depending on the season is a constant, but may be changed to an appropriate value through reevaluation performed periodically or when necessary. Examples of a method for calculating the average include a method in which an average is simply calculated and a method in which an average (a weighted average) is calculated with a larger predetermined value allocated to more recent measurement data. Any of the above-describe method is employed depending on conditions of the system to generate a high-accuracy weight. Next, the determining means 101 transmits the weighted value to the indoor apparatus 310 via the transmitting means 102 and the transmission line 200. In the indoor apparatus 310, the transmitting means 312 receives the weighted value. The operation of the indoor apparatus 310 using the weighted value is the same as that in the first embodiment.

As described above, according to the second embodiment, since the setting unit 100 computes the weighted value, it is possible to change the weighted value depending on the season by providing the setting unit with the schedule function for the past several years and it is possible to change the weighted value depending on the weather obtained through the Internet by providing the setting unit with an internet-connection function. Since it is possible to obtain a more comfortable air conditioning by using standard components without making changes to the air conditioning unit, the system can be used for a wide variety of applications.

Third Embodiment

While the transmission unit 400 is attached to each indoor apparatus 310 in each case in the above-described first and second embodiments, a description in this third embodiment will be given of an embodiment in which the transmission unit 400 is not attached to each indoor apparatus 310, the controlling means 311 does not perform weighted averaging, and a reception unit 430 collectively receives information of the sensor units 410*a* and 410*b*.

Figure 6:
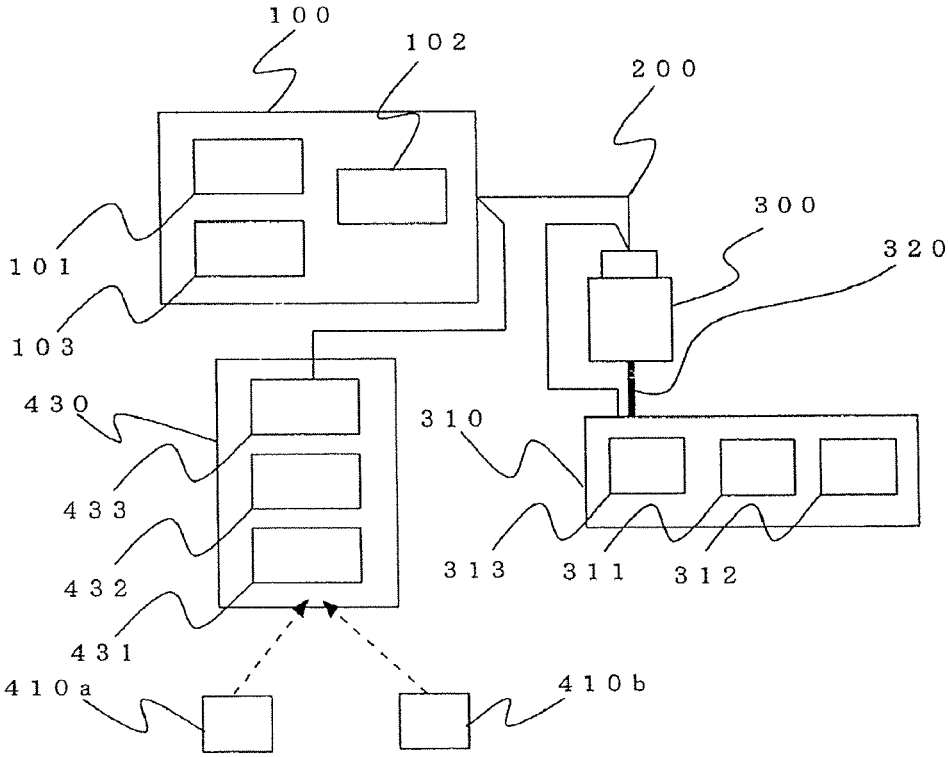
FIG. 6 is a block diagram showing the configuration of an air conditioning system in a third embodiment of the present invention.

FIG. 6 is a block diagram showing the configuration of an air conditioning system in the third embodiment of the present invention. In FIG. 6, the same reference numerals as those in FIG. 5 denote the same or corresponding portions. The configuration of the sensor unit 410 is the same as that shown in FIG. 1. Instead of the controlling means 311 in the indoor apparatus 310, the determining means 101 further has a function for calculating a weighted average. The reception unit 430 includes wireless transmitting means 431 that is in compliance with the ZigBee standard for communicating with the sensor units 410*a* and 410*b*, controlling means 432 for performing protocol conversion, and transmitting means 433 for communicating with the transmitting means 102 in the setting unit 100.

Next, the operation of this third embodiment will be described with reference to FIG. 6.

The reception unit 430 constantly monitors the presence/absence of signals from all the sensors 410*a* and 410*b*. The wireless transmitting means 431 in the reception unit 430 receives the modulated temperature information and sensor-unit identification information from each of the sensor units 410*a* and 410*b*, and demodulates the signals. The controlling means 432 converts the demodulated temperature information and identification information into a protocol for the indoor apparatus, and transmits the information to the setting unit 100 via the transmitting means 433 and the transmission line 200. In the setting unit 100, when the transmitting means 102 receives the temperature information and the sensor-unit identification information, the determining means 101 computes a control value in accordance with the arithmetic expression in FIG. 2, in the same manner as the controlling means 311 in the indoor apparatus in the first embodiment, and transmits the control value to the indoor apparatus 310 via the transmitting means 102 and the transmission line 200. In the indoor apparatus 310, when the transmitting means 312 receives the control value from the setting unit 100, the controlling means 311 controls the operation of the air conditioning unit until the control value matches a set temperature.

As described above, according to this third embodiment, it is not necessary to attach the transmission unit 400 to each indoor apparatus 310, a system including a large number of indoor apparatuses is operable with a small number of wireless transmitting means and is configurable at low cost. Also, a special computation does not have to be performed in the indoor apparatus 310, and a standard indoor apparatus can be used.

The setting unit 100 may be provided with wireless transmitting means so as to also serve as the reception unit.

Although the above-described example has been given of a case in which the controlling means 311 in the indoor apparatus 310 does not calculate a weighted average, it goes without saying that the controlling means may be caused to calculate a weighted average.

Fourth Embodiment

While the sensor units 410*a* and 410*b* in the first, second, and third embodiments merely detect temperatures at the places where they are installed, a description in this fourth embodiment will be given of an embodiment in which the sensor units 410*a* and 410*b* have operation switches so that the user's temperature sensation can be reflected. Any of the configurations in FIGS. 1, 5, and 6 can be applied to the fourth embodiment.

Figure 7:
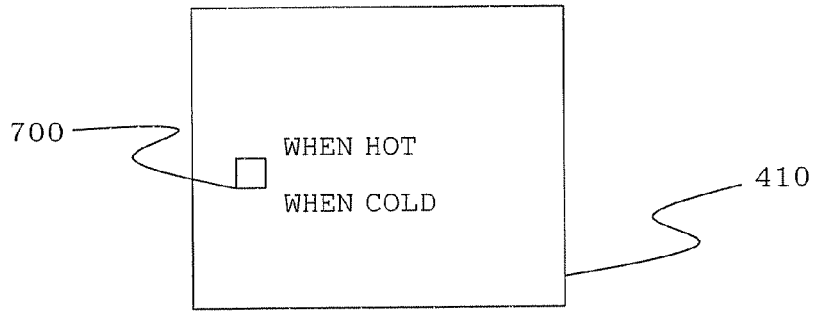
FIG. 7 is a diagram illustrating a state of an operation switch of a sensor unit in a fourth embodiment of the present invention.
Figure 8:
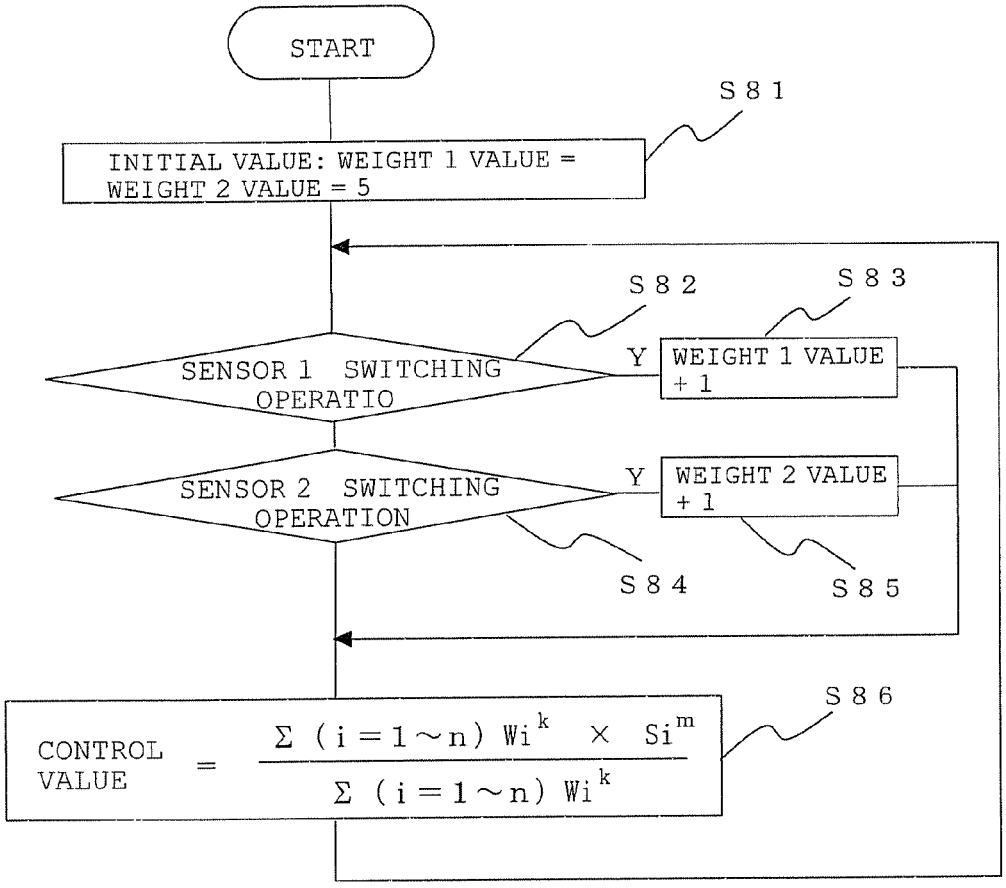
FIG. 8 is a flowchart in the fourth embodiment of the present invention.

FIG. 7 is a diagram illustrating a state of the operation switch of each of the sensor units 410*a* and 410*b* in this fourth embodiment of the present invention. When the user feels hot or cold, he or she operates an operation switch 700 provided at the sensor unit 410 shown in FIG. 7. The sensor unit 410 transmits the operation state of the operation switch via wireless transmitting means that is in compliance with the ZigBee standard. In the example of the configuration in FIG. 1 or FIG. 5, information of the operation state of the switch is transmitted to the transmission unit 400 and, as in the first embodiment, is passed to the controlling means 311 in the indoor apparatus 310. The controlling means 311 computes a control value in accordance with a flowchart in FIG. 8. In the example of the configuration in FIG. 6, the information of the operation state of the switch is transmitted to the reception unit 430 and, as in the third embodiment, is passed to the determining means 101 in the setting unit 100. The determining means 101 computes a control value in accordance with the flowchart in FIG. 8. Next, the operation of the controlling means 311 or the determining means 101 will be described using the flowchart in FIG. 8.

The controlling means 311 (or the determining means 101) sets the initial values of a weight 1 value and a weight 2 value corresponding to the respective sensors 410*a* and 410*b* as $\alpha$ ($\alpha$ is an arbitrary value greater than or equal to 0. In this case, for example, $\alpha=5$) (step S81). A determination is made in step S82 as to whether or not the operation switch 700 is operated. When the operation switch is not operated, the process proceeds to step S84. When the operation switch is operated, the weighted value is increased by $+\beta$ ($\beta$ is an arbitrary positive value. In this case, for example, $\beta=1$) (step S83) and the process proceeds to step S86. In step S84, a determination is made as to whether or not the operation switch 700 is operated. When the operation switch is not operated, the process proceeds to step S86. When the operation switch is operated, the weight value is increased by $+\gamma$ ($\gamma$ is an arbitrary positive value. In this case, for example, $\gamma=1$) (step S85) and the process proceeds to step S86. In step S86, weighted-average calculation is performed using the same expression as that in FIG. 2, based on the weight value(s) obtained in the above-described steps, and the process returns to step S82. When the user still feels hot or cold, he or she operates the operation switch 700 again to thereby further increase the weight value, so that the value of the operated sensor unit is more strongly reflected in the control value.

In this case, the air conditioning unit operates so as to bring the set temperature close to the value in which the sensor value detected by the operated sensor unit is more strongly reflected. When the user changes the set temperature, the temperature may be set to the highest or lowest temperature rather than to a comfortable temperature. However, the set temperature is maintained at a comfortable temperature, the temperature can be finely set so as to correspond to the user's temperature sensation, and the temperature at the sensor-unit location where the user feels hot or cold can be brought closer to a comfortable set temperature.

Fifth Embodiment

Figure 9:
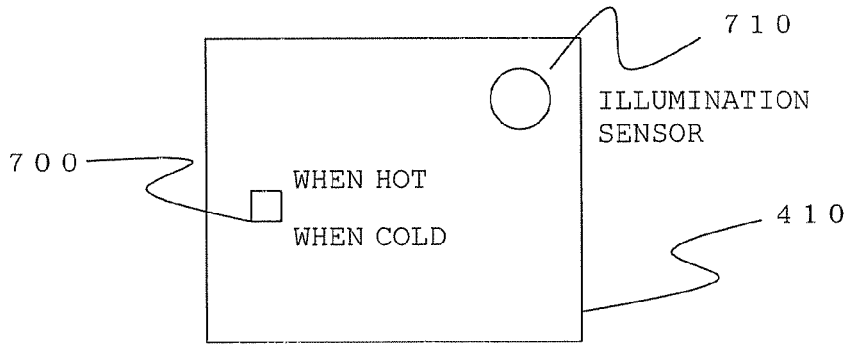
FIG. 9 is a diagram illustrating a state of an operation switch and an illumination sensor of a sensor unit in a fifth embodiment of the present invention.
Figure 10:
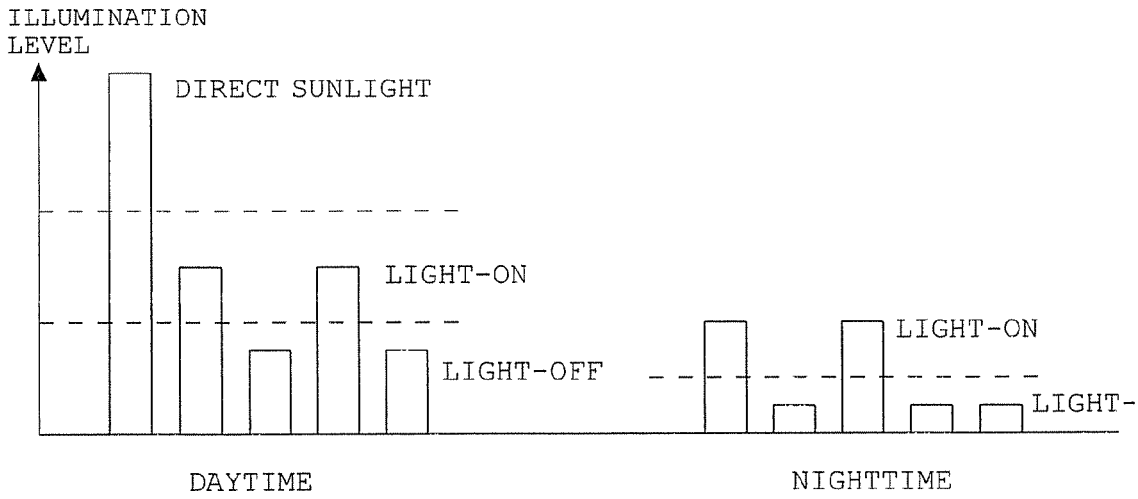
FIG. 10 is a graph showing daytime and nighttime illuminations in the fifth embodiment of the present invention.
Figure 11:
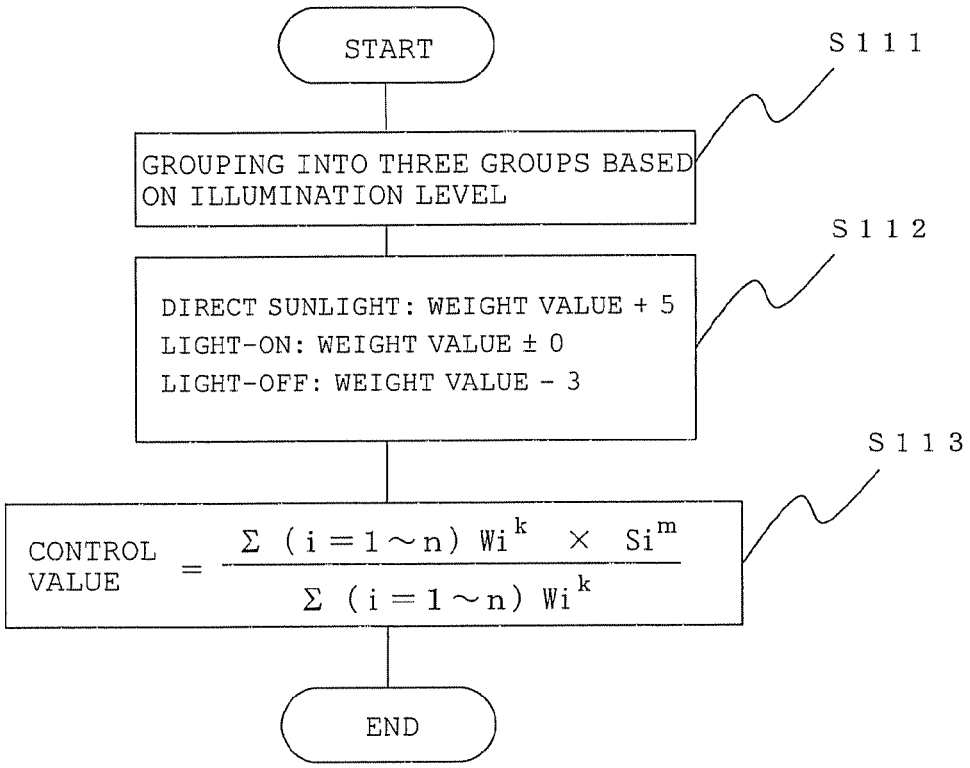
FIG. 11 is a flowchart in the fifth embodiment of the present invention.

Now, a fifth embodiment for a case in which the sensor units 410*a* and 410*b* are provided with illumination sensors 710 and the weighting is changed in accordance with the levels of the illuminator sensors is shown in FIGS. 9, 10, and 11. Any of the configurations in FIGS. 1, 5, and 6 is applicable to this fifth embodiment.

The sensor unit 410 transmits illumination information, detected by the illumination sensor 710, via wireless transmitting means that is in compliance with the ZigBee standard.

In accordance with a flowchart in FIG. 11, the controlling means 311 in the indoor apparatus 310 or the determining means 101 in the setting unit 100 for computing the control value groups the sensor units 410 into three groups depending on the illumination levels detected by the illumination sensors 710 (step S111). For the grouping, for example, as shown in FIG. 10, the sensor unit 410 is grouped into three groups, that is, a group of sensor units installed in areas exposed to direct sunlight, a group of sensor units for light-ON, and a group of sensor units for light-OFF, and weight values for the groups are set to values +5, ±0, and −5, respectively. Because of an influence of light from a window, the absolute values of the illumination levels during light-ON and light-OFF vary between daytime and nighttime, but it is possible to distinguish the absolute values by relative grouping. The controlling means 311 or the determining means 101 sets a weight value corresponding to each level (step S112), and computes a control value based on the weight value (step S113). The indoor apparatus 310 controls the operation of the air conditioning unit until the control value matches a set temperature.

According to this fifth embodiment, the air conditioning control is performed in accordance with the level of the illumination sensor, for example, with an increased degree of influence for a window side where direct sunlight enters and with a reduced degree of influence for a light-OFF portion where no person is present. Thus, a more comfortable climate is provided.

Although the levels of the illumination sensors are grouped into three groups in this case, the levels may be grouped into other plural groups and respective weight values may be set therefor.

Sixth Embodiment

Figure 12:
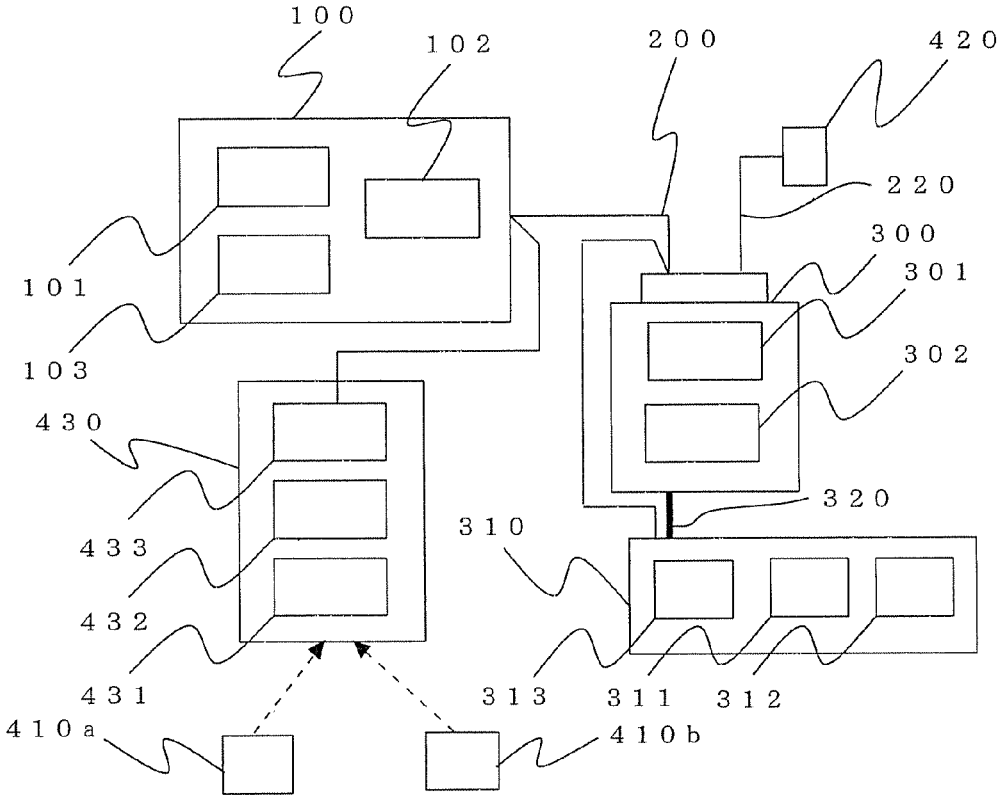
FIG. 12 is a block diagram showing the configuration of an air conditioning system in a sixth embodiment of the present invention.
Figure 13:
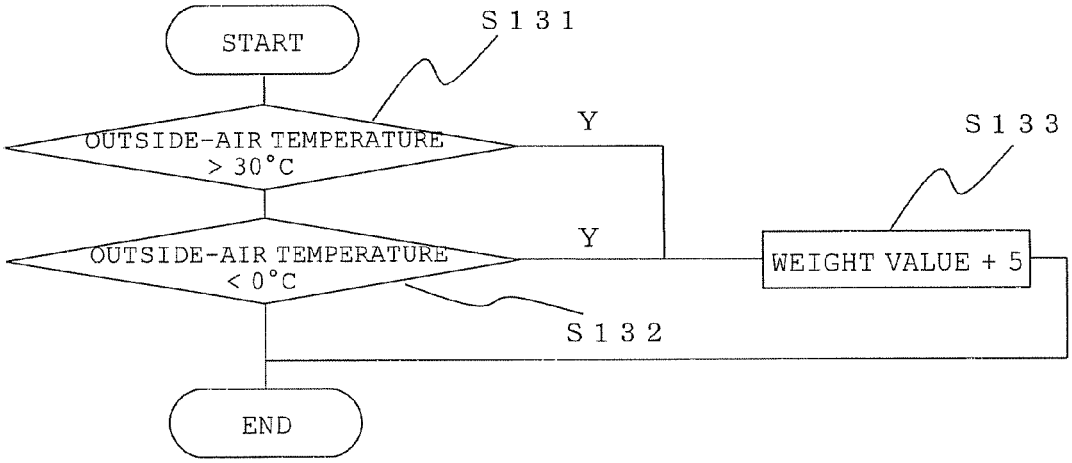
FIG. 13 is a flowchart in the sixth and a eighth embodiments of the present invention.

Here, a sixth embodiment in which the outdoor apparatus 300 is provided with an outside-air temperature sensor 420 is shown in FIGS. 12 and 13. In FIG. 12, the same reference numerals as those in FIG. 6 denote the same or corresponding portions. The outside-air temperature sensor 420 is connected to the outdoor apparatus 300 via a signal line 220. The outdoor apparatus 300 has, as standard equipment, transmitting means 301 for receiving temperature information of the outside-air temperature sensor and controlling means 302.

Next, the operation of the sixth embodiment will be described using FIGS. 12 and 13.

The outside-air temperature detected by the outside-air temperature sensor 420 is transmitted to the outdoor apparatus 300 through the signal line 220. In the outdoor apparatus 300, when the transmitting means 301 provided as standard equipment receives the outside-air temperature from a port, the controlling means 302 transmits the outside-air temperature from another port of the same transmitting means 301. The outside-air temperature transmitted from the outdoor apparatus 300 is transmitted as an outside-air temperature value to the indoor apparatus 310 or the setting unit 100, which computes the control value, via the transmission line 200. When the outside-air temperature exceeds 30° C. or falls below 0° C. (step S131 or S132), the controlling means 311 in the indoor apparatus 310 or the determining means 101 in the setting unit 100, for computing the control value, increases the weight value for the sensor unit 410*a* or 410*b* installed at a window side (step S133), in accordance with the flowchart shown in FIG. 13.

In this sixth embodiment, when the outside-air temperature is hot or cold, the temperature at the window side is more greatly reflected in the control value.

The outdoor apparatus 300 may be provided with the outside-air temperature sensor 420 and a humidity sensor to determine outside-air enthalpy based on detected values thereof and to compute a weight value based on the determined outside-air enthalpy.

Seventh Embodiment

Figure 14:
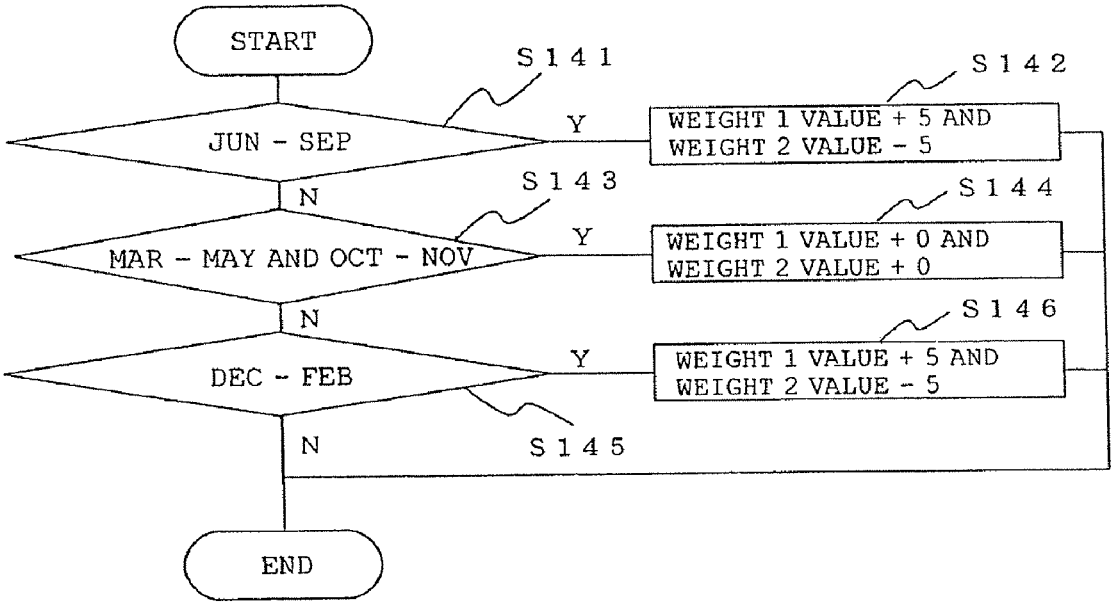
FIG. 14 is a flowchart in a seventh embodiment of the present invention.

Here, a seventh embodiment in which the setting unit 100 is provided with a schedule function is shown in FIG. 14.

The setting unit 100 changes the weight value in accordance with a schedule. For example, in the flowchart in FIG. 14, in the summer season in June through September and in the winter season in December through February (steps S141 and S145), the weight 1 value for the sensor unit 410*a* installed at the window side is set to a reference value+5 (steps S142 and S146) and the weight 2 value for the sensor unit 410*b* installed at the back of the room is set to the reference value−5, and in intermediate periods in March through May and October through November (step S143), the weight value for the sensor unit 410*a* installed at the window side and the weight value for the sensor unit 410*b* installed at the back side of the room are set to the same reference value+0 and the temperatures are equally processed (step S144).

Thus, in a season when the outside-air temperature is hot or cold, the temperature at the window side can be more strongly reflected in the control value. Also, the outside-air temperature sensor does not have to be installed and the cost is reduced.

The weight value may be changed in units of hour for the segments of the morning, daytime, and nighttime, not in units of month.

Eighth Embodiment

Figure 15:
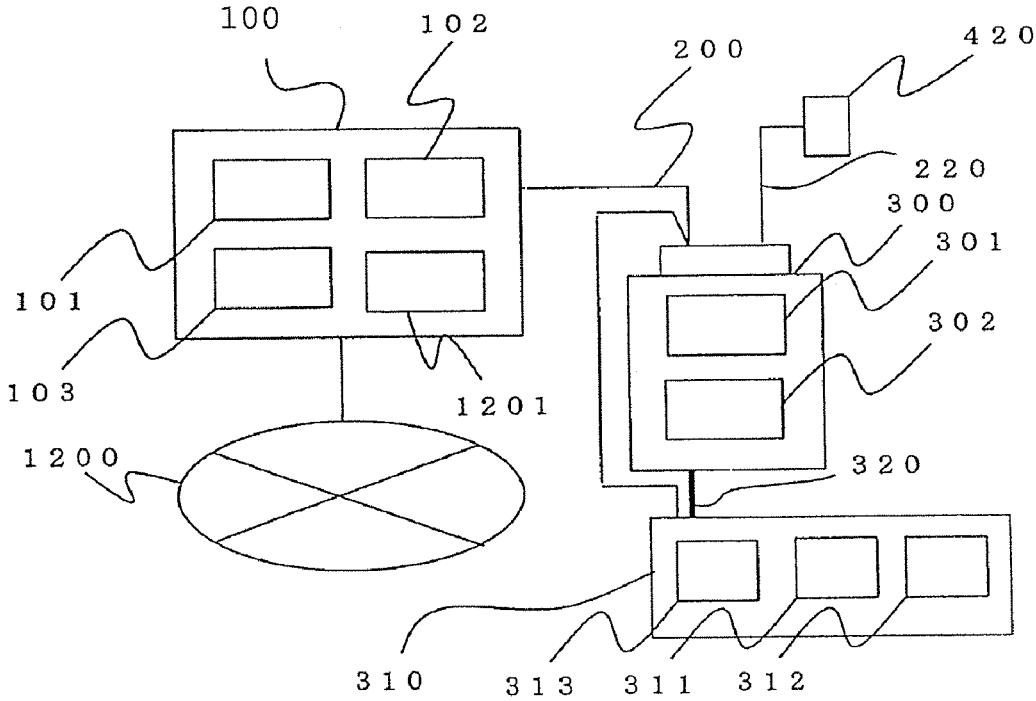
FIG. 15 is a block diagram showing the configuration of an air conditioning system in the eighth embodiment of the present invention.

Here, an eighth embodiment in which the setting unit 100 is connected to the Internet is shown in FIG. 15.

In FIG. 15, the same reference numerals as those in FIG. 1 denote the same or corresponding portions. As shown in FIG. 15, the setting unit 100 is connected to an Internet 1200.

Figure 16:
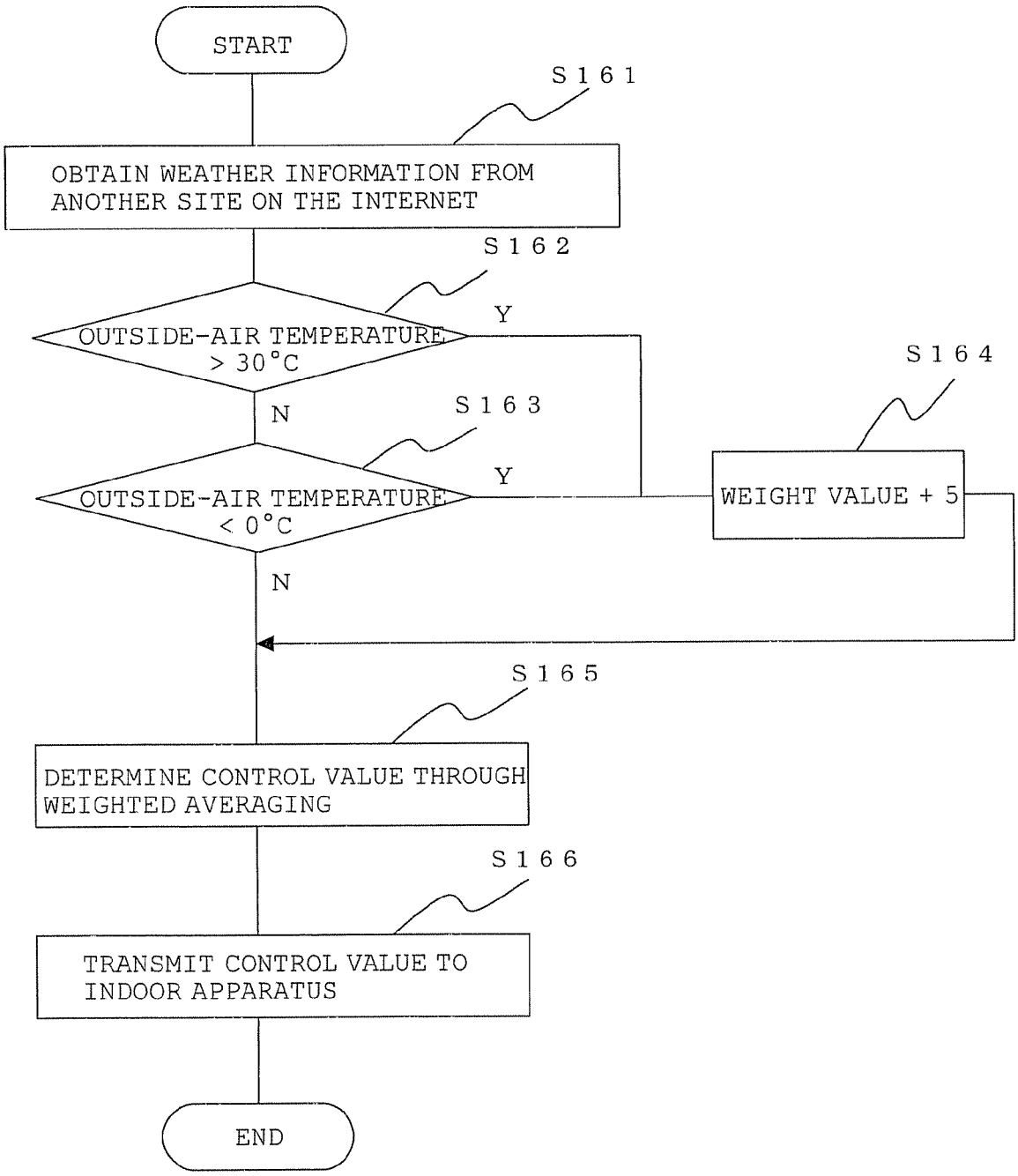
FIG. 16 is a flowchart of determining means in the eighth embodiment of the present invention.

FIG. 16 is a flowchart showing the operation of the determining means 101 in this eighth embodiment.

Next, the operation of the eighth embodiment will be described with reference to FIGS. 15 and 16.

In the setting unit 100, the determining means 101 obtains weather-forecast information (hereinafter referred to as "weather information") from another site, connected to the Internet 1200, via transmitting means 1201 (step S161). When the outside-air temperature in the temperature information for this region, the information being obtained from the Internet 1200, has a predetermined value that exceeds a range which people in rooms can tolerate, the weight is increased by a predetermined value (step S164). Specifically, when it is forecast that the outside-air temperature exceeds 30° C. or falls below 0° C. (step S162 or S163), the weight value for the sensor unit 410*a* installed at the window side is increased by a predetermined value (e.g., by 5 in this case). Next, based on the weight value, the determining means 101 determines a control value (step S165) in accordance with the expression in FIG. 2, and transmits the control value to the indoor apparatus 310 via transmitting means 102*a* and the transmission line 200 (step S166). In the indoor apparatus 310, upon receiving the control value via the transmitting means 312, the controlling means 311 controls the air conditioner in accordance with the control value.

Thus, since more intensive air conditioning is performed on the window side, it is possible to prevent an extraordinary temperature of the outside air from affecting the area in the room through a window and it is possible to prevent the range of temperatures that are tolerable by the users from being exceeded.

As described above, when the outside-air temperature is hot or cold, the temperature at the window side can be more strongly reflected. Also, the outside-air temperature sensor does not have to be installed and the cost is reduced.

Ninth Embodiment

Figure 17:
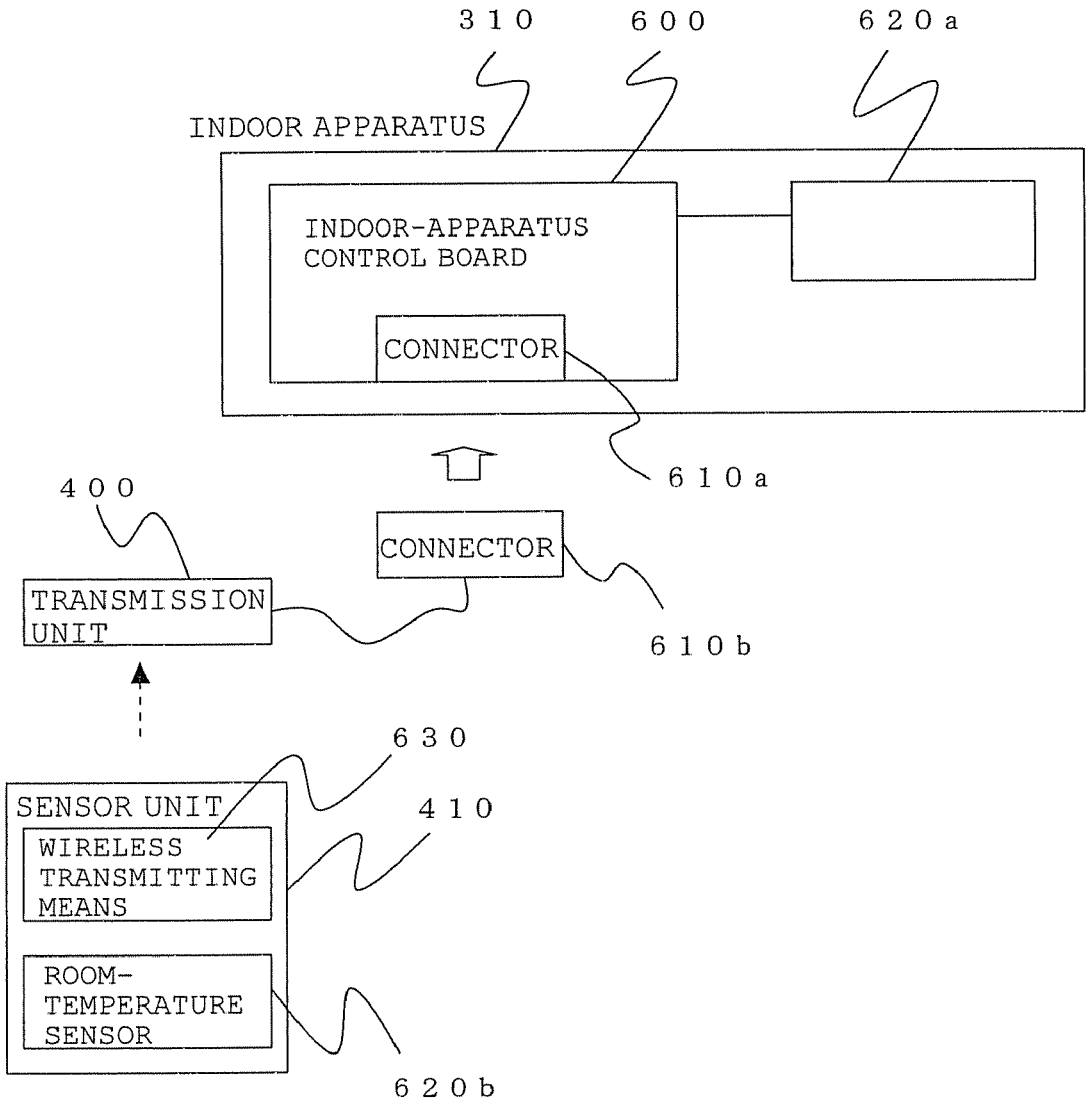
FIG. 17 is a block diagram showing the configuration of an air conditioning system in a ninth embodiment of the present invention.

Here, a ninth embodiment in which wireless transmitting means is detachably attached to the indoor apparatus 310 is shown in FIG. 17.

The indoor apparatus 310 has therein an indoor-apparatus control board 600 and a room-temperature sensor 620*a*. The indoor-apparatus control board 600 has a connector 610*a* to which a transmission unit 400 having a connector 610*b* can be connected. The indoor apparatus 310 can exchange information with a sensor unit 410 having wireless transmitting means 630 and a room-temperature sensor 620*b* via the transmission unit 400. Using selecting means, the indoor apparatus 310 can select the room-temperature sensors 620*a* and 620*b* to be used.

With this arrangement, for a user who does not want to use a wireless sensor, the transmission unit 400 does not have to be attached and the cost is thus reduced.

Tenth Embodiment

Figure 18:
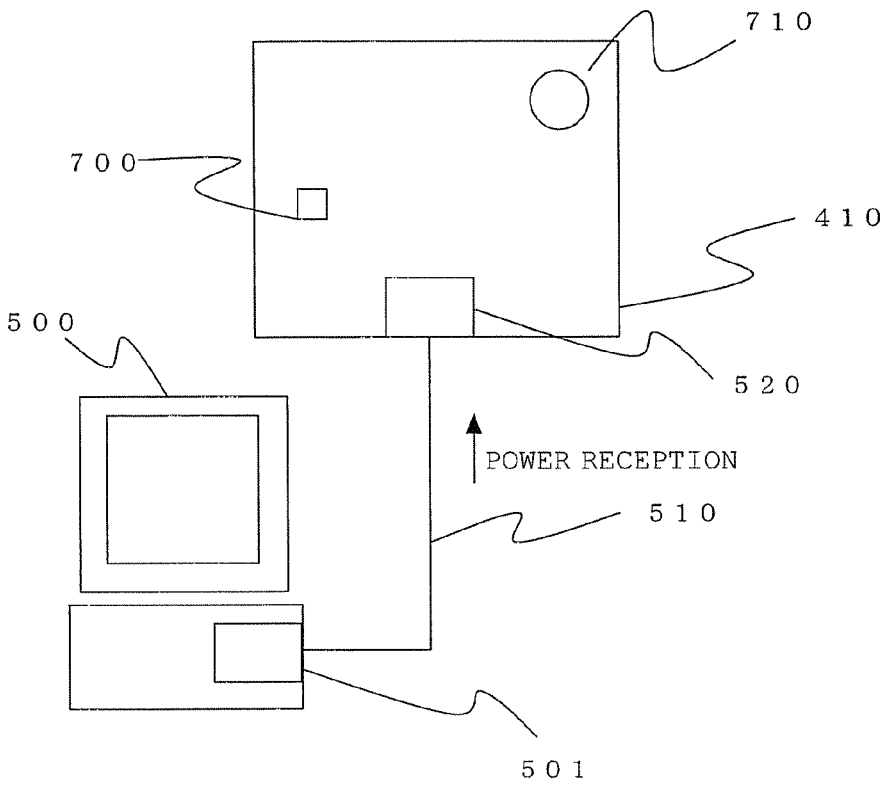
FIG. 18 is a diagram illustrating a state of power reception using an USB in a tenth embodiment of the present invention.

In this tenth embodiment, an embodiment in which the sensor units 410*a* and 410*b* obtain power supply from a USB (Universal Serial Bus) 510 included in electronic equipment, such as a personal computer, is shown in FIG. 18.

Each sensor unit 410*a* or 410*b* has an USB terminal 520 and is connected to a personal computer 500 through the USB 510. A USB port 501 of the personal computer 500 is provided with an AC 100 V terminal and a 0 V terminal. During operation of the personal computer, each sensor unit 410*a* or 410*b* can obtain power supply from the terminal. Thus, connection of the USB port 501 and the USB terminal through the USB 510 causes power to be supplied to each sensor unit 410*a* or 410*b*. The sensor unit 410 may be provided with a rechargeable battery so as to operate continuously even at the time when the personal computer 500 is powered off. When the user is not present during the power-off of the personal computer 500 and ignoring the room temperature at the place is not problematic, the battery may not be provided so that the operation stops when the personal computer 500 is powered off.

In recent years, since various types of electronic equipment used indoors are increasingly provided with USB ports, it is not any more difficult to find a USB port indoors. Thus, it is possible to obtain a wireless sensor that does not require periodic battery replacement.

Eleventh Embodiment

In this eleventh embodiment, in a room such as in an office where variations in temperature occur prominently, there is a case in which air conditioning cannot be performed with one air conditioner. In this case, it is possible to eliminate the problem of the temperature variations by installing a plural and minimum number of air conditioners intensively at spots where the temperature variations are significant and by more finely controlling the air conditioners. Such an embodiment is described in the eleventh embodiment.

Figure 19:
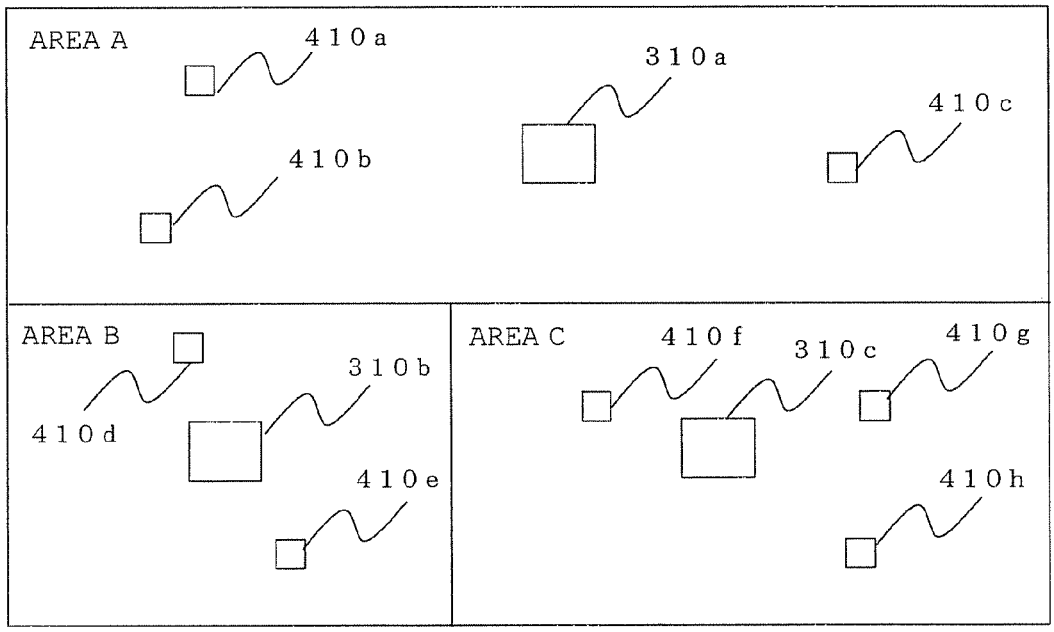
FIG. 19 is a diagram illustrating a state of installation of indoor apparatuses and sensor units in an eleventh embodiment of the present invention.

In this eleventh embodiment, reference is also made to FIG. 1. As shown in FIG. 19, the states of temperature variations in areas in a room are checked in advance and one air conditioner and multiple sensor units are installed in each area where temperature variations are particularly significant. While any method may be used to check the states of the temperature variations, for example, a radiation sensor described below or the like may be used for the checking. In the example in FIG. 19, an indoor apparatus 310*a* and sensor units 410*a* to 410*c* are installed in area A, an indoor apparatus 310*b* and sensor units 410*d* and 410*e* are installed in area B, and an indoor apparatus 310*c* and sensor units 410*f* to 410*h* are installed in area C.

As shown in FIG. 1, the identification information set by the unit-identification-information setting means 412 in the sensor units 410 and the temperature information measured by the temperature sensors 411 are transmitted to the indoor apparatuses 310 (310*a*, 310*b*, and 310*c*) via the wireless transmitting means 413, the transmission units 400, and the transmission-dedicated lines 210.

In the indoor apparatuses 310, upon receiving the identification information and the temperature information via the transmission units 400 and the transmission-dedicated lines 210, the controlling means 311 calculate weighted averages based on the pre-stored values Wi of weights i (i=a, b, . . . , h) for the sensor units 410*a* to 410*h* in the areas and the values Si of the sensors i that are the temperature information of the sensors, in accordance with the expression in FIG. 2, regard the results of the calculation as a control value C, and control the operations of the air conditioning units 310*a*, 310*b*, and 310*c* until the control value matches a set temperature.

In this manner, the indoor apparatus installed in each area in the room obtains a weighted average using the temperatures detected by the plural temperature sensors and the unit identification information, and controls the temperature in the area based on the result of the weighted value. This makes it possible to finely prevent temperature variations in the room.

Twelfth Embodiment

The description in the eleventh embodiment has been given of a case in which the plural indoor apparatuses control the air conditioning in the room when temperature variations occur in the room. It is, however, possible to reduce temperature variations at low cost by reducing the number of air conditioners to 1, dividing the area into areas for blowout directions of a louver, obtaining a weighted average of temperatures detected by plural temperature sensors that exist in the area for each area, and controlling the louver of the indoor apparatus based on the result of the weighted average to thereby change the wind direction. Such an embodiment will be described in this twelfth embodiment.

Figure 20:
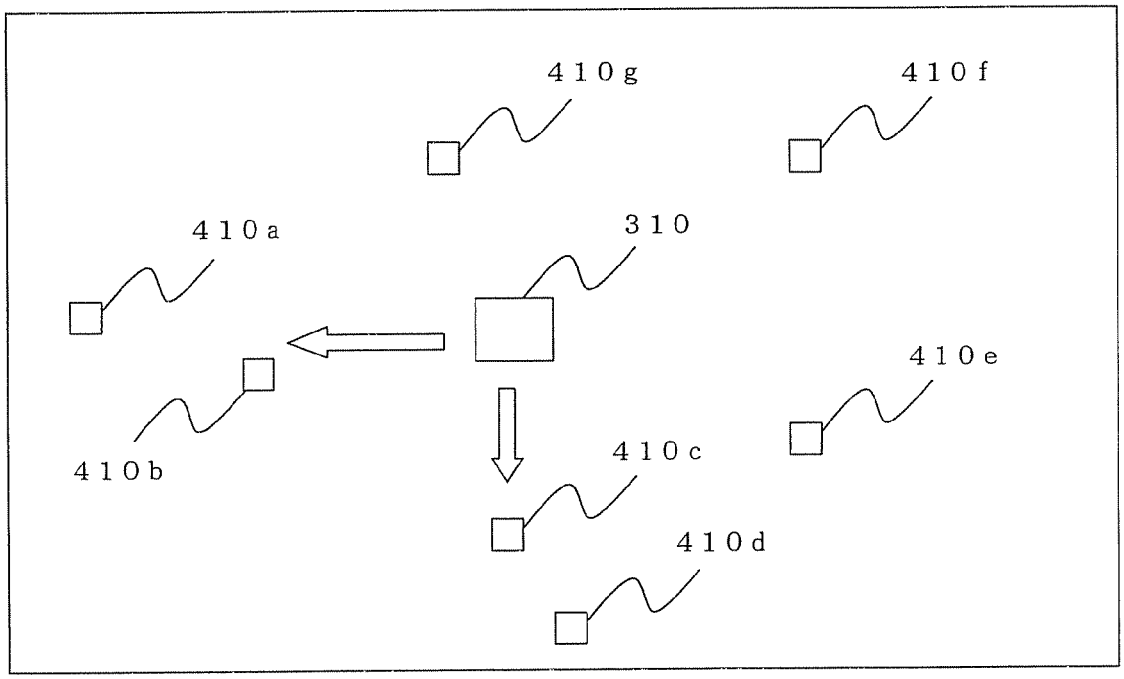
FIG. 20 is a diagram illustrating a state of installation of an indoor apparatus and sensor units in a twelfth embodiment of the present invention.
Figure 21:
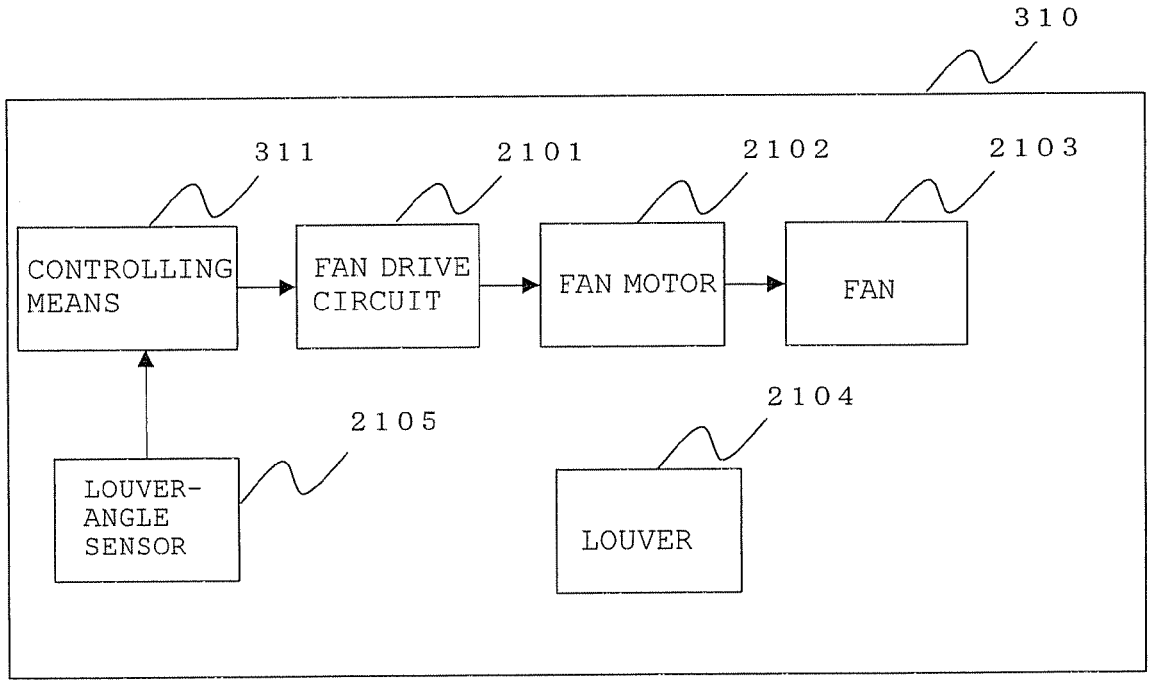
FIG. 21 is a configuration diagram (part 1) of a louver control system in the twelfth embodiment of the present invention.

The operation of the twelfth embodiment will be described next. FIG. 1 is also used in this twelfth embodiment. FIG. 20 is a diagram illustrating the state of installation of an indoor apparatus 310 and sensor units 410*a* to 410*g* in the twelfth embodiment of the present invention. FIG. 21 is a configuration diagram of a louver control system in the twelfth embodiment of the present invention. As shown in FIG. 21, the louver control system is provided in the indoor apparatus 310 and is constituted by, instead of a fan drive mechanism (not shown) that is provided in an indoor apparatus as standard equipment, a fan drive circuit 2101, a fan motor 2102, a fan 2103, and a louver-angle sensor 2105 for detecting the angle of a louver 2104. Next, the operation of this twelfth embodiment will be described using FIGS. 20 and 21.

During operation of the indoor apparatus, when the automatic swinging of the wind direction is set using a remote controller, a louver drive mechanism (not shown) that is provided in the indoor apparatus 310 as standard equipment allows the louver 2104 to constantly blow out wind while changing its angle in the range of a minimum angle to a maximum angle at a constant speed. Accordingly, the indoor apparatus 310 is provided with the louver-angle sensor 2105 for detecting the angle of the louver 2104. Also, the positions of the sensor units 410*a* to 410*g* are measured in advance, and a table in which the louver angles (in predetermined increments, e.g., in increments of one degree or in increments of a few degrees), the sensor units that exist in the air blowout directions corresponding to the angles, and weight values thereof are associated with each other is registered in storing means 313 in the indoor apparatus 310.

Then, each time the louver-angle sensor 2105 detects a change in the louver angle, the controlling means 311 in the indoor apparatus 310 reads out the table stored in the storing means, to obtain the sensor units that exist in the air blowout directions corresponding to the above-mentioned louver angles and the weight values thereof.

For example, when the indoor apparatus 310 directs the louver 2104 in a blowout direction indicated by the black arrow, the controlling means 311 in the indoor apparatus 310 recognizes that the sensor units 410*a* and 410*b* exist in the area in the direction, based on the table stored in the storing means, and also obtains the weight values thereof. Accordingly, by computing a weighted average using the temperature information transmitted from the sensor units 410*a* and 410*b* and the weight values obtained from the table, as described above, the controlling means 311 can obtain a control value for the direction. Based on the control value, the controlling means 311 controls the amount of blowout of the air conditioning unit in that direction. That is, the controlling means 311 outputs the determined control value to the fan drive circuit 2101, so that the fan motor 2102 is rotated at a rotation speed corresponding to the control value and wind having an amount corresponding to the rotation speed blows out of the fan 2103.

Also, when the indoor apparatus 310 turns the louver 2104 in a blowout direction indicated by the white arrow, the controlling means 311 in the indoor apparatus 310 similarly recognizes that the sensor units 410*c* and 410*d* exist in the area in the direction. Thus, by obtaining a weighted average using the temperature information sent from these sensor units and the preset weight values, the controlling means 311 can obtain a control value for the direction. Based on the control value, the controlling means 311 controls the amount of blowout of the air conditioning unit in the direction, in the same manner as described above.

As described above, according to this twelfth embodiment, when a room is controlled using one indoor apparatus, the room is divided into areas for respective louver blowout directions, a weighted average relating to the temperature information from the plural sensor units that exist in respective areas and the preset weights is computed for each area, and the amount of wind blowout is controlled based on the result of the computation and in accordance with the direction of the louver of the above-described indoor apparatus. Thus, it is possible to reduce the temperature variations at low cost, compared with the eleventh embodiment.

Figure 22:
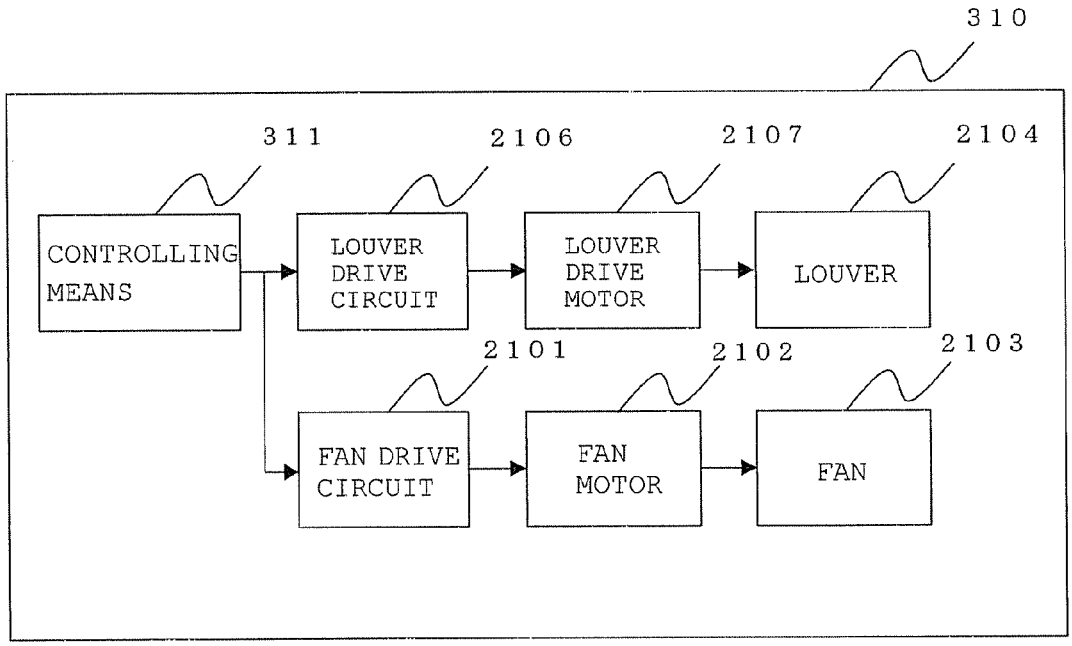
FIG. 22 is a configuration diagram (part 2) of the louver control system in the twelfth embodiment of the present invention.

Although the description in the above example has been given of a case in which the amount of blowout is controlled while the direction of the louver is being changed at a constant speed, the amount of blowout per unit time may be fixed to control the moving speed of the direction of the louver 2104. FIG. 22 is a configuration diagram showing one example of this arrangement. In this case, instead of the louver drive mechanism that is provided in the indoor apparatus 310 as standard equipment, a louver drive motor 2107 such as a stepping motor for controlling the angle of the louver 2104 and a louver drive circuit 2106 for controlling the louver drive motor 2107 are further added. The controlling means 311 in the indoor apparatus 310 outputs, as an instruction value, a predetermined value to the fan drive circuit 2101 to thereby cause the amount of blowout corresponding to the instruction value to blow out. Fixing the instruction value makes it possible to hold the amount of blowout constant. A fan mechanism that is provided in the indoor apparatus as standard equipment may be used for the fan.

Also, the controlling means 311 has angle information of the louver 2104, identifies the sensor units 410 (410*a* and 410*b* or 410*c* and 410*d*) based on the angle information and the above-described table, and computes a weighted average relating to the temperature information transmitted from the sensor units 410 (410*a* and 410*b*, or 410*c* and 410*d*) and the weight values obtained from the table, thereby making it possible to obtain a control value in the direction. Next, based on the control value, the controlling means 311 determines a stay time at the current louver angle. Then, during the operation of the indoor apparatus, the controlling means 311 outputs, as an instruction value, the angle information of the louver 2104 and the stay time at the angle to the louver drive circuit 2106. As a result, the louver driver circuit 2106 drives the louver drive motor 2107, so that the angle of the louver 2104 changes according to the instruction.

The angle information outputted by the controlling means 311 is sequentially changed in predetermined increments (e.g., in increments of one degree or in increments of a few degrees) in the range of a predetermined minimum value to a predetermined maximum value (e.g., 0 to 90°). For example, the controlling means 311 repeats an operation for sequentially increasing the angle of the louver 2104 at a speed corresponding to the control value, then sequentially reducing the angle at a speed corresponding to the control value when reaching the above-mentioned maximum value, and sequentially increasing the angle at a constant speed again when reaching the above-mentioned minimum value. As a result, the angle of the louver 2104 with respect to the control value determined with a large weight changes slowly, and the angle of the louver 2104 with respect to the control value determined with a small weight quickly changes.

In this manner, a weighted average relating to the temperature information from the plural sensor units that exist in each area and the preset weights is computed for each area, and, while the wind direction is being changed through control of the direction of the louver of the indoor apparatus based on the result of the computation, the time of blowing out of the wind is controlled. Thus, the total amount of wind bowing out in one direction of the louver is the same as that described above, and the same advantage is obtained.

Thirteenth Embodiment

Air conditioning control for equipment having a large heating value will now be described. For example, since a rack mount server, i.e., sever computers mounted on plural racks, has a significantly large heating value compared to other electronic products, the temperature of the ambient air is more likely to increase. Thus, when the cooling of the rack mount server is insufficient, a malfunction may occur due to exceeding of the operating temperature range of the server. Accordingly, it is necessary to sufficiently cool the rack mount server to maintain the operating temperature range. Such an embodiment will be described in this thirteenth embodiment.

Figure 23:
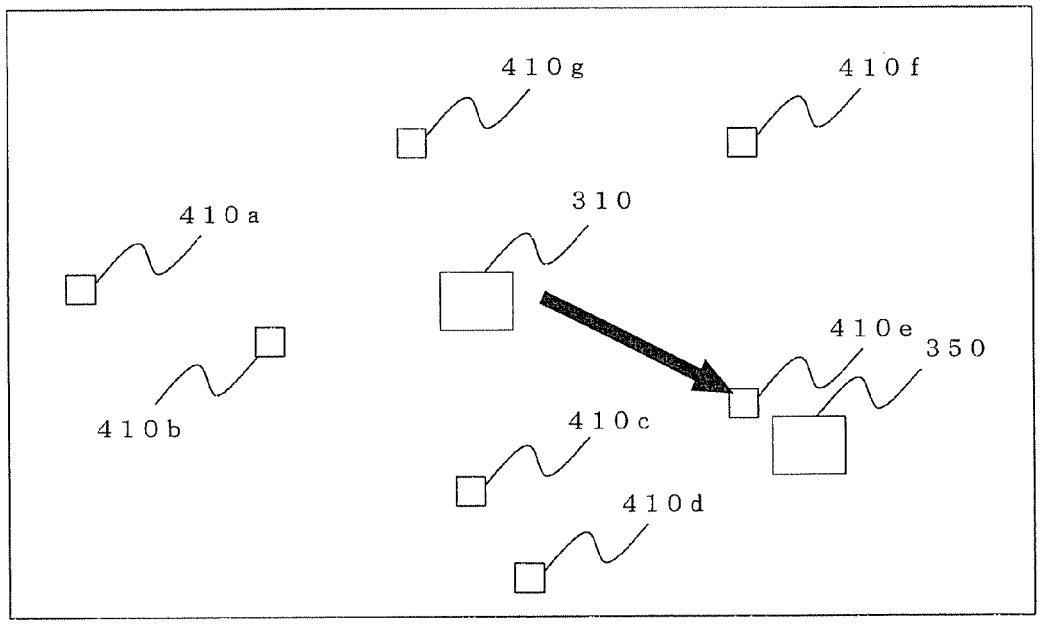
FIG. 23 is a diagram illustrating a state of installation of an indoor apparatus and sensor units in a thirteenth embodiment of the present invention.

The operation of this thirteenth embodiment will be described next. FIG. 1 is also used in this thirteenth embodiment. FIG. 23 is a diagram illustrating the state of installation of an indoor apparatus 310 and sensor units 410 in the thirteenth embodiment of the present invention.

The controlling means 311 in the indoor apparatus 310 stores the equipment operating temperature range, the identification information of the corresponding sensor units, and the weight values thereof in the storing means as a table in the storing means 313. The controlling means 311 periodically compares the temperature information from all sensor units 410*a* to 410*g* with the operating temperature range stored in the storing means 313. When the temperature information from the sensor unit 410*e* provided at a rack mount server 350 exceeds the rack-mount-server operating temperature range stored in the storing means 313, the controlling means 311 reads out the identification information of the sensor unit corresponding to the operating temperature range from the table to thereby identify the corresponding sensor unit 410*e*. The controlling means 311 increases the weight for the sensor unit 410*e* to calculate a weighted average and uses the result of the calculation as a control value to operate the indoor apparatus 310. The controlling means 311 repeats such an operation until the temperature information from the sensor unit 410*e* falls within the pre-registered rack-mount-server operating temperature range.

During the weighted averaging, it is also preferable to set the weight values for the sensors other than the sensors provided in the rack mount server to 0 in order to give top priority to the cooling of the rack mount server. With this arrangement, the cooling of the rack mount server is performed with top priority.

Also, the sensor unit 410*e* is switched from periodic monitoring to constant monitoring or the interval of the periodic monitoring is reduced. This allows temperatures around the rack mount server to be more quickly brought into the operating temperature range.

It is also preferable that the weight for the weighted averaging be a weight that is proportional to a deviation between the rack-mount-server operating temperature range and the sensor temperature. With this arrangement, when the rack mount server is much hotter than the operating temperature range, rapid cooling is performed. This facilitates that the temperature enters the operating temperature range smoothly without overshoot, when the temperature reaches the operating temperate range. As a result, the rack mount server falls within the operating temperature range very quickly.

According to this thirteenth embodiment, since air conditioning control is performed based on the result of the weighted averaging with a maximum weight given to the temperature sensor that is the closest to equipment having a large heating value. Thus, it is possible to maintain the operating temperature range of the equipment having the large hearing value.

Fourteenth Embodiment

In general, temperatures at places where people gather are higher than temperatures at places where no people are present. For example, when the temperature at a place where no people are present is around 32° C., the temperature at a place where people gather reaches close to 35 to 36° C. Accordingly, a description in this embodiment will be given of an air conditioning system that utilizes the configuration in FIG. 1 and a radiation sensor (e.g., Move Eye (trademark)) that is provided in a ceiling-installation-type indoor apparatus and is capable of extensively monitoring infrared rays in a room in a left and right range of 150° in a temperate control area below the indoor apparatus.

Figure 24:
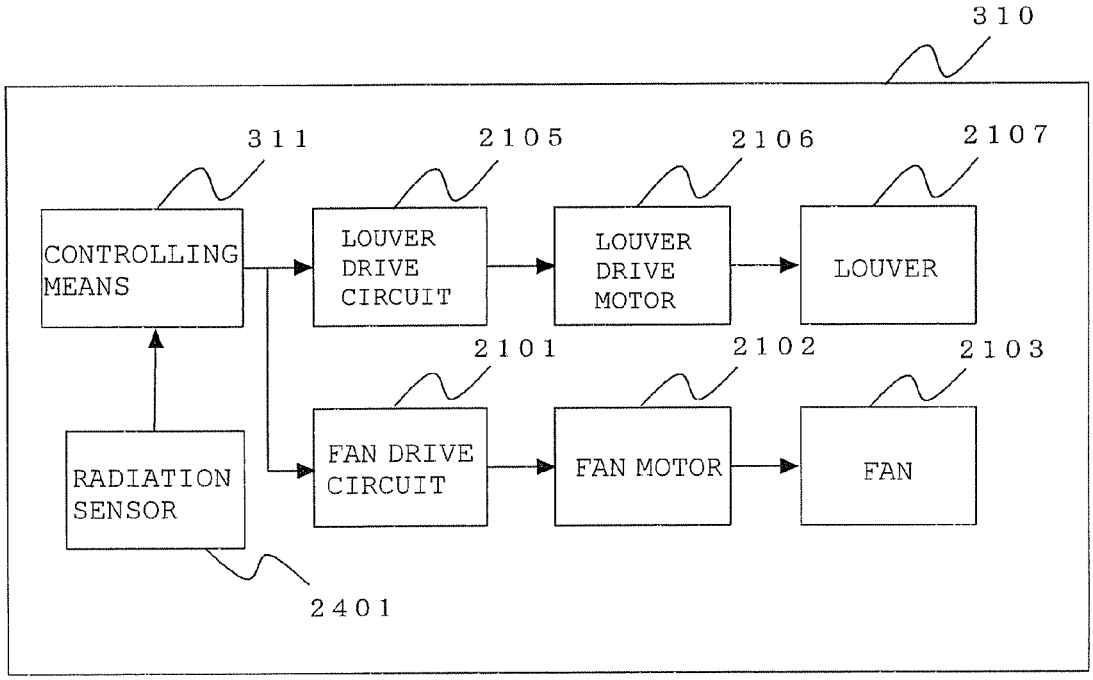
FIG. 24 is a configuration diagram using a radiation sensor in a fourteenth embodiment of the present invention.
Figure 25:
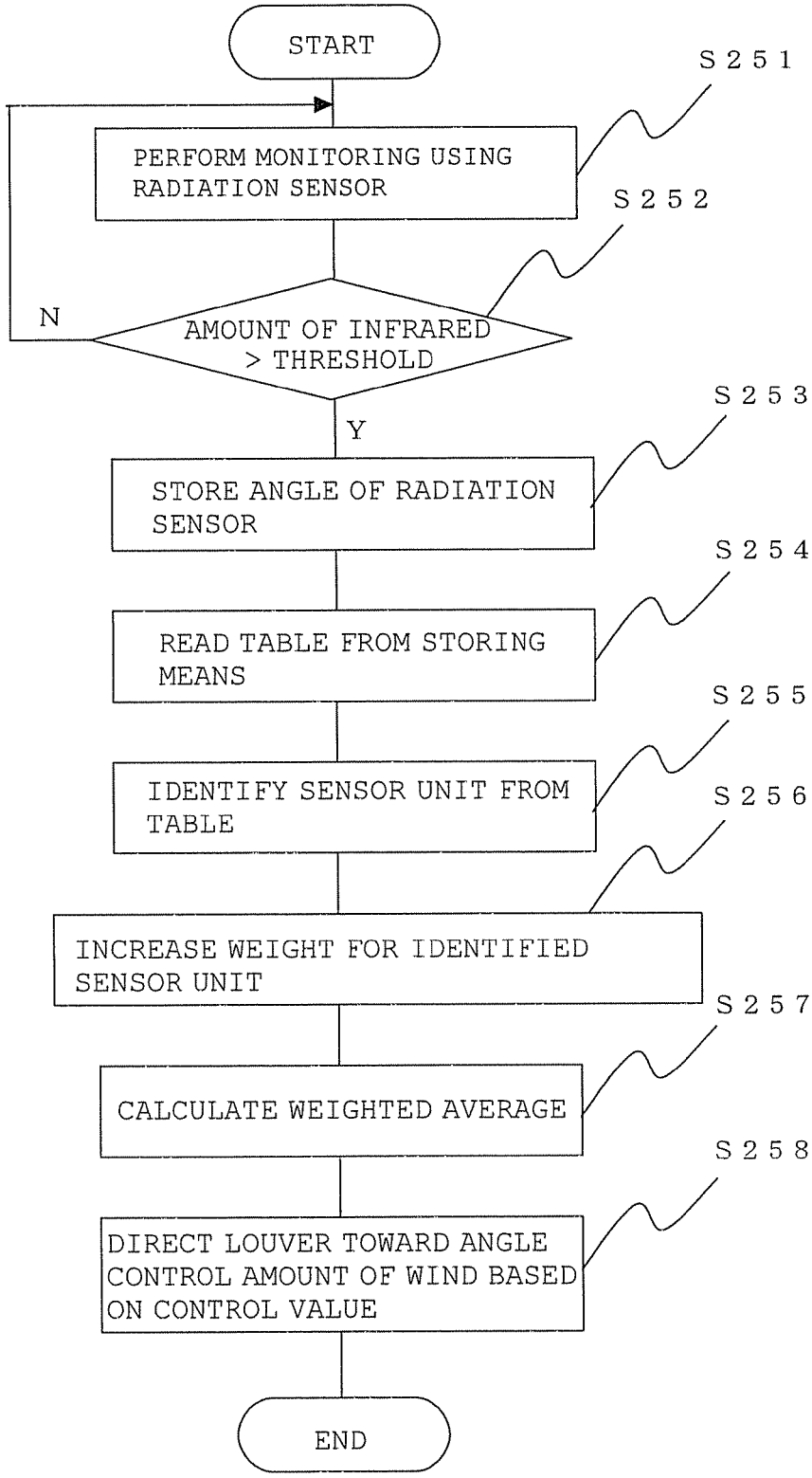
FIG. 25 is a flowchart showing the operation of the fourteenth embodiment of the present invention.

FIG. 24 is a configuration diagram using the radiation sensor in the fourteenth embodiment. In FIG. 24, the same reference numerals as those in FIG. 22 denote the same or corresponding portions, and thus, the descriptions thereof are omitted. In this case, a radiation sensor 2401 is added to the configuration in FIG. 22. FIG. 25 is a flowchart showing the operation of this fourteenth embodiment.

Next, the operation of the fourteenth embodiment will be described using FIGS. 24 and 25.

Also, for example, a reference temperature is set to 34° C. and the reference temperature is pre-stored in internal storing means. Also, a table, in which angles indicating the directions of the radiation sensor and the identification information of at least one sensor unit that exists in an area influenced by wind blowing out in the directions of the angles are associated with each other in order with the closest sensor first is stored in the storing means.

In this state, the radiation sensor 2401 searches for and monitors, a place where the temperature is higher than or equal to the above-mentioned reference temperature (step S251), while sequentially changing the angle at a constant speed in a left and right range of 150°. Upon detecting infrared rays that is stronger than a predetermined threshold (step S252), the radiation sensor 2401, the controlling means 311 in the indoor apparatus 310 determines that users gather at the position in that direction, stores the direction in the storing means (step S253), and reads out the table from the storing means (step S254). Based on the identification information of the sensor units, controlling means 311 selects at least one of the sensor units in order with the sensor unit that is the closest to the position at the angle first (step S255), increases the weight value(s) for the selected sensor unit(s) (step S256), and determines a weighted average using the expression in FIG. 2 to thereby obtain a control value (step S257). The controlling means 311 then directs the louver in the direction detected by the radiation sensor, and as in the twelfth embodiment, controls the amount of blowout from the fan based on the control value (step S258).

In this manner, according to the fourteenth embodiment, the radiation sensor provided in the ceiling-installation type indoor apparatus to monitor a temperature control area therebelow can intensively perform air conditioning on space where people are present and can maintain a comfortable environment.

Fifteenth Embodiment

In this fifteenth embodiment, a learning function is added. For example, during one season, results obtained by weighting are periodically recorded and data obtained by averaging the results is used as a default value to set the temperature and to control the air conditioner.

For the averaging, such an arrangement may be adopted that the amount of data to be stored is limited to a predetermined value, and every time the latest data is stored, the oldest data is erased and a greater weight is given to more recent data, so as to perform weighted averaging.

When the memory capacity is limited, the interval for the recording is adjusted in accordance with the length of the period for the checking. For example, when only 31 memory areas exist, the interval for recording is changed in such a manner that, for recording for each month, the recording is performed once a day, for recording for each season, the recording is performed once every four days, for recording for each year, the recording is performed once every 12 days, and for recording for each week, the recording is performed four times a day.

As described above, according to this fifteenth embodiment, it is not necessary for the user to perform a temperature setting operation via an operation unit, and after the startup, an air conditioning environment that is more suitable for his/her current physical condition is quickly launched as a default value. Thus, a comfortable climate can be obtained quickly.

Sixteenth Embodiment

A description in this sixteenth embodiment will be given of an embodiment that is intended for plural users in a room such as an office.

The number of users is pre-registered in the storing means for the controlling means in the indoor apparatus through manual work or the like.

The weights for respective sensors required for controlling the room temperature are learned in advance through experiment or the like, and a table in which room temperatures and sensor weights corresponding to the room temperatures are associated with each other, for example, in increments of 1° C. is pre-stored in the storing means.

Every time temperature setting from a worker is received, the worker whom the temperature is required from is determined and the number of workers is counted by a counter.

Only when a set temperature at which the number of workers exceeds a predetermined rate, for example, half the workers, appears, the association table is read out from the storing means, the weight corresponding to the set temperature is retrieved, and the weight is switched to a weight of the weighted average. The subsequent operation is analogous to that in the first embodiment.

As described above, according to the sixteenth embodiment, when a set temperature at which the number of people who request for changing the temperature exceeds a predetermined rate is reached, the weight is changed so as to switch the temperature. Thus, it is possible to provide half or more of the people in the room with a comfortable environment.

Although the arrangement in this case was adapted to meet the requests from half or more of the people, the number thereof may be determined as needed and may be ⅔ or more of the people or all of the people.

Seventeenth Embodiment

The description in the fourteen embodiment has been given of an embodiment in which the temperature of a person and the maximum air temperature detected by the sensor unit are distinguished therebetween based on a predetermined reference temperature. However, in a hot season in midsummer, the temperature at a window side may exceed the reference temperature (e.g., 34° C.) in midday, and in some cases, it is difficult to distinguish between a person and non-person. This tendency is more significant, particularly, in countries located closer to the equator than Japan. Accordingly, a description in the seventeenth embodiment will be given of an embodiment that utilizes an RFID tag in order to reliably determine whether or not it is a person.

Figure 26:
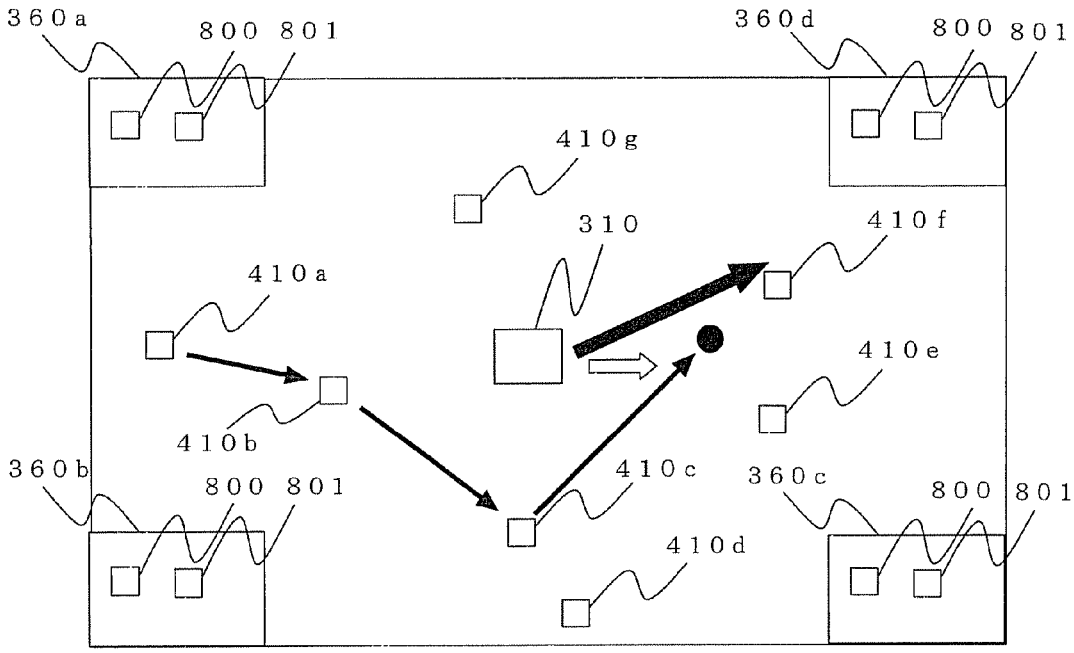
FIG. 26 is a diagram illustrating a relationship between a state of user movement and air conditioning performed by an indoor apparatus.

As shown in FIG. 26, RFID readers 360 (360*a* to 360*d*) equipped with wireless transmitting means 800 are provided at plural spots (e.g., four corners in a room). Also, plural sensor units 410*a* to 410*g* are installed in the room and the positions thereof are pre-measured by a method that is irrelevant to the present invention and are recognized by the controlling means 311 in the indoor apparatus 310.

Also, read commands are sent periodically (e.g., at intervals of 100 milliseconds) from the RFID readers 360*a* to 360*d* into the space and whether or not a response is received from an RFID tag is monitored.

When an important user such as a client or a VIP comes on a visit, he or she attaches an RFID tag for transmitting unique identification information to the RFID readers 360*a* to 360*d* in response to the read commands from the RFID readers 360*a* to 360*d* to him or herself. Two or more of the RFID readers 360 constantly monitor the position of the important user even when he or she moves. Important-user position information and time information which are read from controlling means 801 in the RFID readers 360 are transmitted to the controlling means 311 in the indoor apparatus 310 via the wireless transmitting means 800. In the indoor apparatus 310, upon receiving the important-user position information and the time information from two or more RFID readers via the wireless transmitting means 312, the controlling means 311 determines the position of the important user by a known triangulation method, based on the received information. The controlling means 311 further extracts, from the table, the sensor unit 410 that is the closest to the determined important-user position, and calculates a weighted average with a weight being intensively given to the extracted sensor unit 410. Using the result of the calculation as the amount of control, the controlling means 311 changes the direction of the louver so that it is directed toward the important user to control air conditioning.

Also, the plural pieces of important-user position information and time from the RFID readers 360*a* to 360*d* are stored in the storing means in the order in which the most recent position information and time come first, the movement speed and the movement direction of the important user are determined based on the stored position information and the time, and the weights for the sensor units 410*f* and 410*e* installed at movement destinations in the room are made large. Based on the weight values, an air conditioning operation is performed on a movement destination in advance, as indicated by a black-filled, thick arrow in FIG. 26. This arrangement can prepare a comfortable environment where the air conditioning is already effected when the important user passes through the position.

A black-filled, thin arrow in FIG. 26 indicates the movement of the important user.

As described above, according to the seventeenth embodiment, it is possible to perform air conditioning control using one air conditioner so that an important client feels comfortable at any time when the important client is in the room, and the degree of satisfaction of the important client can be enhanced.

Eighteenth Embodiment

A description in this eighteenth embodiment will be given of an embodiment of a case intended for plural office "desk" workers.

The number of all workers is pre-registered. Also, a temperature range in which weighted averaging is performed is registered. When plural workers are present in a room, it can be assumed that the workers set different temperatures one after another. One worker may frequently perform temperature setting and another worker may less frequently perform temperature setting in a predetermined time. A case of a large number of settings in the predetermined time indicates that the urgency of the setting request of the worker is large, and it can be assumed that the temperature environment of the position where the worker is seated is worse than that of other positions and the temperature environment gradually improves as distance therefrom increases. Also, when a large number of temperature settings are generated from plural spots, it can be assumed that the temperature environments of the plural spots are not favorable.

Accordingly, the number of temperature settings performed by each worker is counted in predetermined increments (e.g., in units of 1° C.) and the number of settings for each temperature for each worker is periodically checked (When checking of the number of setting is finished and data of the number of settings still remains at the time of the next checking, it is difficult to perform processing, and thus, the number of settings in the table is reset to 0). Some temperatures are extracted in order of decreasing number of settings, for example, in order of a temperature for which the number of settings is the largest, a temperature for which the number of settings is the second largest, a temperature for which the number of settings is the third largest, and so on, and a weight corresponding to the number of settings are given thereto. For example, the weight having a value that is proportional to the number of settings is used. A weighted average is calculated based on the weight, and air conditioner is controlled based on the result of the calculation.

Figure 27:
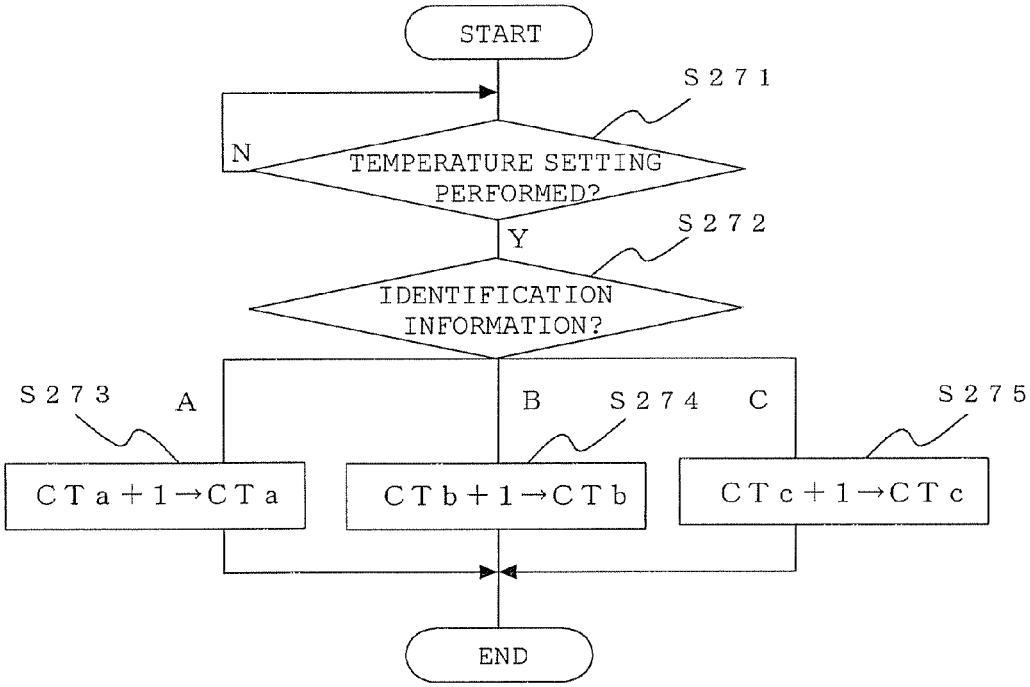
FIG. 27 is a diagram illustrating an operation (part 1) of an air conditioning system in an eighteenth embodiment of the present invention.
Figure 28:
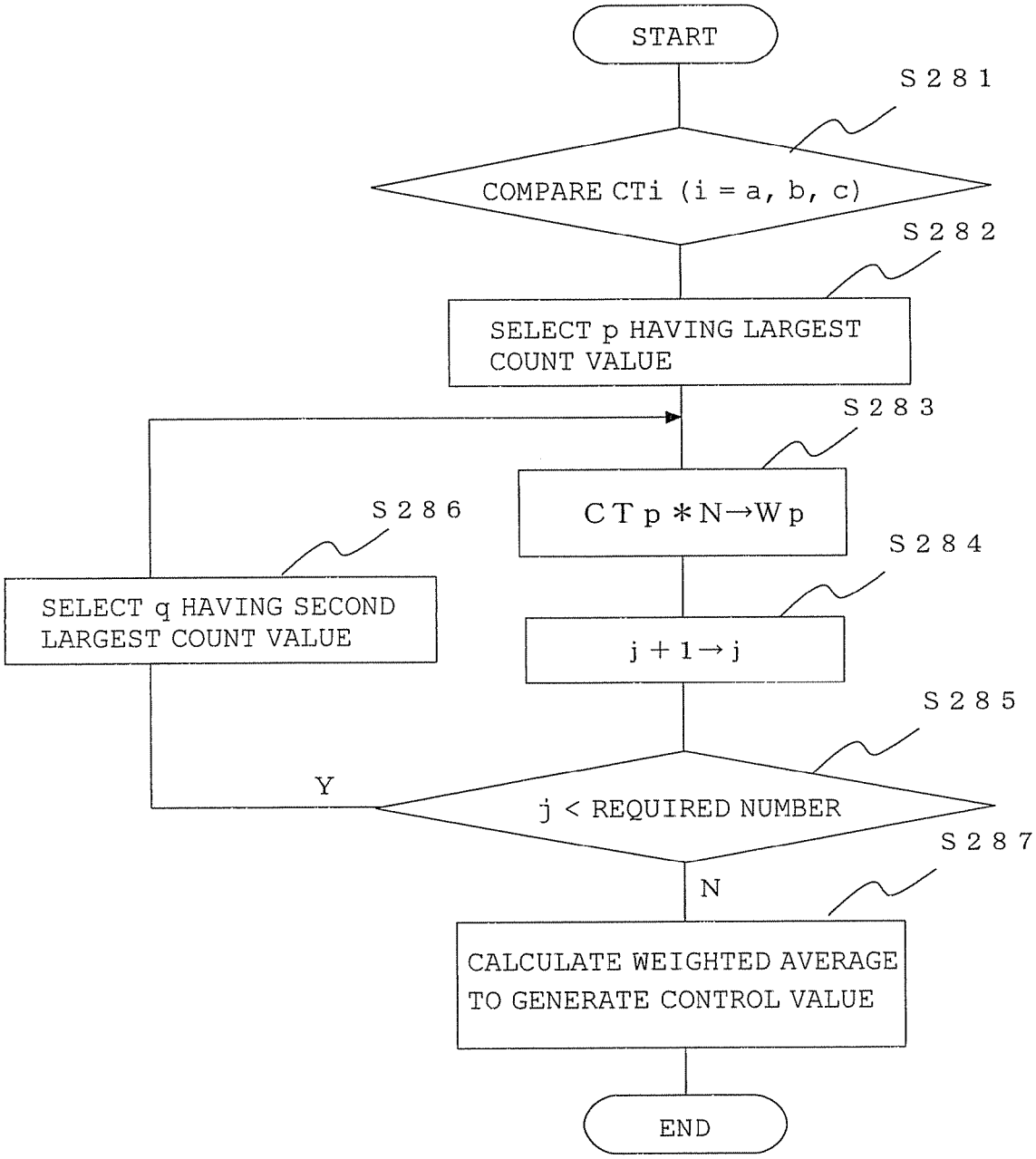
FIG. 28 is a diagram illustrating an operation (part 2) of the air conditioning system in the eighteenth embodiment of the present invention.

FIGS. 27 and 28 are flowcharts showing the above-described operation. FIG. 27 is a flowchart for a function for updating the number of temperature settings each time the temperature is set, and the update is constantly executed. FIG. 28 is a flowchart showing a function for retrieving some temperatures in order of decreasing number of updated temperature settings and for outputting a weight corresponding to the number of settings. Either function is executed by the controlling means 311 in the indoor apparatus 310, but may be executed by the determining means 101 in the setting unit 100.

The operation in FIG. 27 will be described next. In step S271, a determination is made as to whether or not temperature setting is performed by a user. When no temperature setting is performed, the process returns to step S271 to continue the same monitoring. When temperature setting is performed by a user, the identification information of the remote controller or the sensor unit is checked (step S272) in order to check from which user the setting is received. Although the identification information of only three people is shown in this flowchart, the identification information according to the number of users exists in practice.

When the received identification information is A, a count value CTa in the storing means is increased by 1 (step S273). When the received identification information is B, a count value CTb in the storing means is increased by 1 (step S274). When the received identification information is C, a count value CTc in the storing means is increased by 1 (step S275).

The operation in FIG. 28 will be described next.

In step S281, the controlling means 311 retrieves all users' count values CTi (in this case, i=a, b, and c for three users) from the storing means 313, performs comparison, and selects a count value having the largest value (step S282). Next, a weight value Wj is generated by multiplying the selected count value by a proportionality coefficient N (the value of N is arbitrary and is determined according to the system) (step S283). The value of j is then increased by 1 (step S284). The value of j is assumed to be preset to 0. Next, whether or not j reaches a required number is checked (step S285). When j does not reach the required number, a count value having the second largest count value is selected (step S286), the process returns to step S283, and the weight value Wj thereof is generated. When j reaches the required number, a weighted average is calculated based on the obtained weight value by using the expression in FIG. 2 to obtain a control value (step S287). Thereafter, although not shown in the flowchart, the controlling means 311 performs air conditioning control based on the calculated control value, as in the first embodiment.

As described above, according to the eighteenth embodiment, since the weight for a person who performed temperature setting many times is increased, it is possible to improve the temperature environment of a worker who is in a working environment where the temperature situation is severe.

When the number of settings for each worker is updated and registered, the remote controllers and the workers owning the remote controllers are associated with each other on a one-to-one basis. That is, every time the worker operates his/her own remote controller to set the temperature, a remote-controller-identification code generated from the remote controller and a worker code are associated with each other. Each time a management apparatus receives the remote-controller identification code and temperature information generated from the remote controller by operation of the remote controller, the management apparatus counts the number of received remote-controller identification codes for each temperature of 1° C. and records the counted number to a built-in memory in association with the temperature and the remote-controller identification codes.

The above-described operation is performed on all workers.

On the other hand, when the number of settings for each worker is to be counted, the controlling means executes other read-dedicated software to periodically read out the number of settings for each temperature for each worker from the memory and checks the number of settings.

Nineteenth Embodiment

The arrangement may be such that, when the user sets a temperature at which a deviation between the set temperature and the temperature of the actual space to be air-conditioned exceeds a range in which the weighted averaging is possible, the air conditioning control based on the weighted average computation is temporarily stopped and conventional air conditioning control is performed so as to change the temperature to a set temperature desired by the worker. Such an embodiment will be described in this nineteenth embodiment.

The number of all users is pre-registered in the storing means.

When the number of users is 1 and the deviation between the temperature set by the worker and the temperature of the actual space to be air-conditioned exceeds a range in which the weighted averaging is possible, the controlling means 311 in the indoor apparatus 310 switches the operation control of the air conditioner to conventional air-conditioning control.

Figure 29:
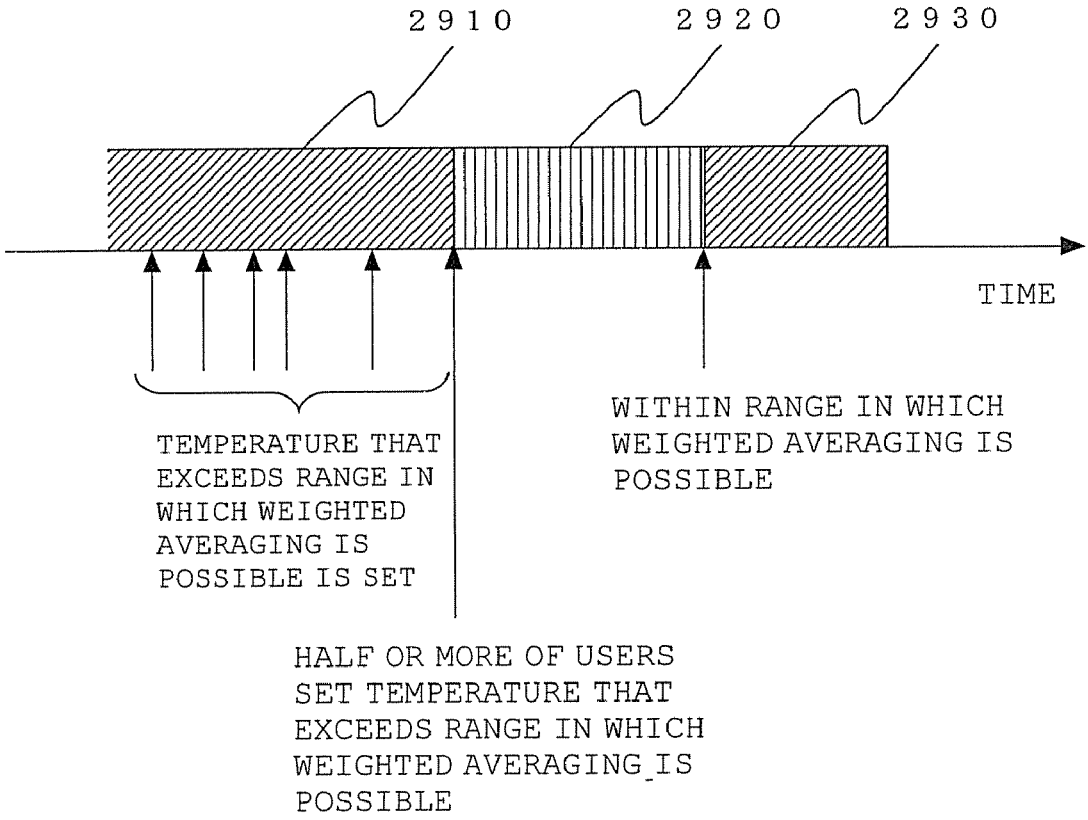
FIG. 29 is a diagram illustrating the operation of an air conditioning system in a nineteenth embodiment of the present invention.

Also, during execution of air conditioning control based on the weighted average, as shown by 2910 in FIG. 29, when plural users set temperatures at which the deviations between the set temperatures and the temperatures of the actual space to be air-conditioned exceed the range in which the weighted averaging is possible, the controlling means 311 in the indoor apparatus 310 counts the number of users who performed the temperature setting, based on the number of remote controllers that transmitted the set-temperature information. When the number of users who performed the temperature setting is greater than or equal to a predetermined rate of the number of all users registered in the storing means, for example, is greater than or equal to half the number thereof, the air conditioner control based on the weighted average calculation is temporarily stopped and the control is switched to conventional air-conditioner control using a room-temperature sensor, as shown by 2920 in FIG. 29. As a result, the intake temperature of the air conditioner is controlled so that it is equal to the set value. In this case, when the air conditioner is a ceiling-installation type, it is away from the actual position of the person and thus the control is not so accurate because of a deviation from the intake temperature. However, since the air conditioning control is more powerful than the air conditioning control based on the weighted average, it is possible to quickly bring the temperature close to a user-desired temperature, compared to the air conditioning control based on the weighted average.

During the air conditioning control of the conventional system, when the controlling means determines that the temperature enters the range in which the weighted averaging is possible, based on the temperature information detected by the sensor units 410, the air conditioning control of the conventional system is stopped in turn and the air conditioning control based on the weighted average is resumed as shown by 2930 in FIG. 29. This can prevent overshoot, and moreover, can accurately and smoothly cause the temperature to reach the set-value temperature. The above-described arrangement allows for, as whole, air conditioning control that rapidly and accurately brings the temperature to the temperature(s) set by the user(s).

Figure 30:
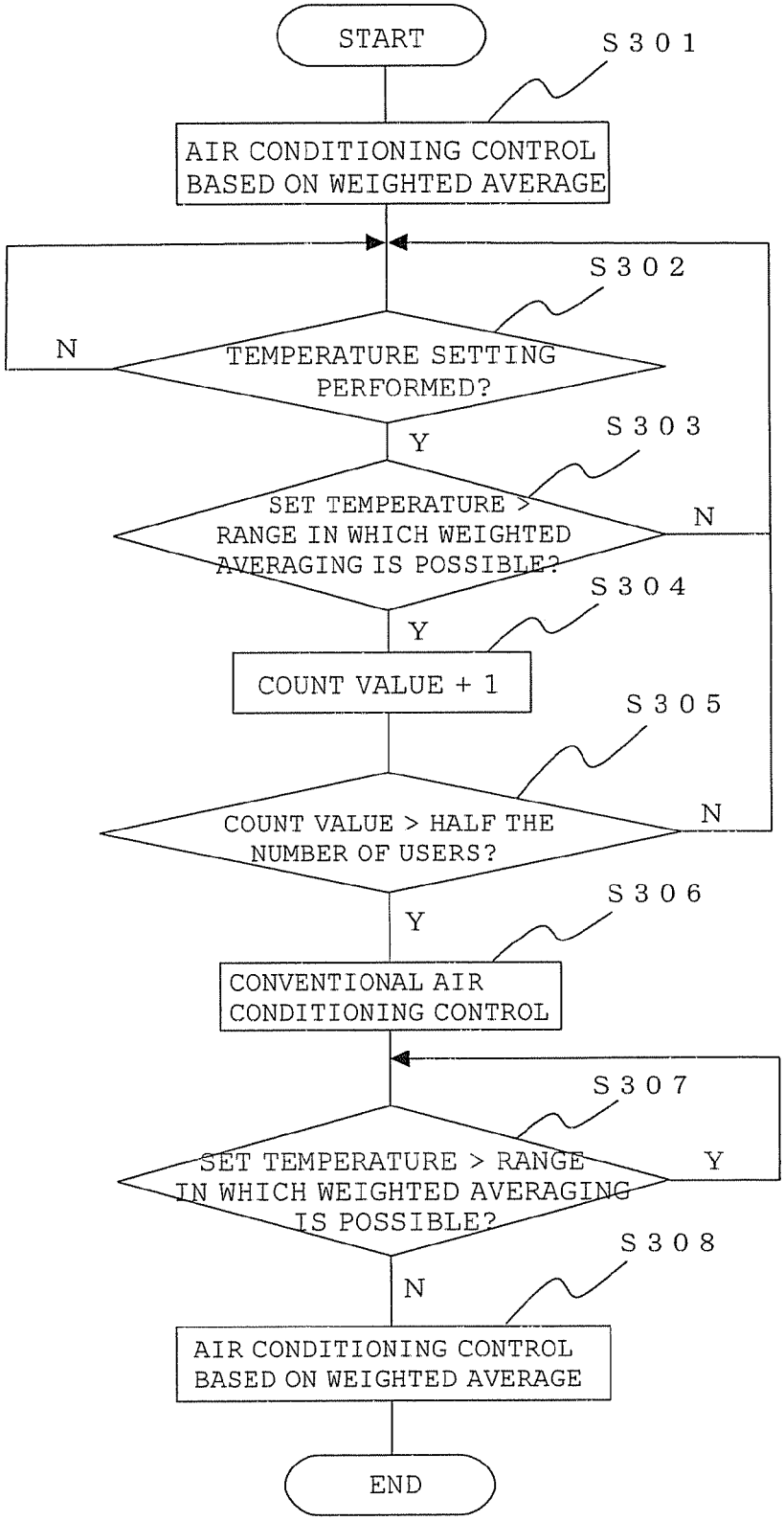
FIG. 30 is a flowchart showing the operation of the air conditioning system in the nineteenth embodiment of the present invention.

FIG. 30 shows the above-described operation.

Air conditioning control based on the weighted average is performed (step S301), and during this processing, it is checked whether or not temperature setting is performed (step S302). When no temperature setting is performed, the process returns to step S302 to continue the air conditioning control. When temperature setting is performed in step S302, it is checked whether or not the set temperature exceeds a range in which the weighted averaging is possible (step S303). When the set temperature does not exceed the range, the process returns to step S302 to continue the air conditioning control. When the set temperature exceeds the range in which the weighted averaging is possible in step S303, a count number that is stored in the storing means and that represents the number of users is increased by 1 (step S304).

Next, it is checked whether or not the count value exceeds a predetermined rate relative to the number of users, in this case, half the number of users (step S305). When the count value does not exceed half the number of users, the process returns to step S302 to continue the air conditioning control.

When the count value exceeds half the number of users in step S305, the control is switched from the air conditioner control based on the weighted average calculation to the conventional air conditioner control (step S306). Then, it is checked whether or not the set temperature exceeds the range in which the weighted averaging is possible (step S307). When the set temperature exceeds the range, the process returns to step S307 to continue the conventional air conditioner control. When it is determined in step S307 that the set temperature enters the range in which the weighted averaging is possible, the control is switched from the air conditioning control of the conventional system to the air-conditioning control based on the weighted average (step S308).

As described above, according to the nineteenth embodiment, when the number of people who set temperatures at which the deviations between the temperature-setting values and the actual temperature of the space to be air-conditioned exceed the range in which the weighted averaging for the air conditioning is possible exceeds a predetermined rate, the control is temporarily switched to the conventional air conditioning control, not to the air conditioning control based on the weighted average. Thus, it is possible to quickly improve the temperature environment of users who are in a severe temperature environment.

Twentieth Embodiment

There may also be a case in which the temperature of equipment to be air-conditioned increases rapidly and the temperature information from a temperature sensor in the vicinity of the equipment has a value that significantly exceeds the weighted average.

Accordingly, before the weighted average calculation is performed, the temperature information detected by each temperature sensor and the average value of past temperature information are compared with each other. When the temperature information detected by one temperature sensor is greatly different from the average value of the past temperature information by a predetermined value or more, it is determined that the temperature information is erroneous and is excluded from temperature information to be subjected to the weighted average calculation and weighted average calculation is performed based on the other sensor information. Also, an external alarm apparatus is caused to display or sound an alarm indicating that the equipment provided with the sensor unit that detected the extraordinary temperature is malfunctioning.

In this manner, according to the twentieth embodiment, it is possible to not only notify the users about the malfunction of the equipment so as to allow them to take action, but also prevent erroneous air conditioning control due to erroneous temperature information.

The term "means" that serves as a constituent element illustrated in each embodiment is, specifically, a "circuit", a "device", or a "program" and the like.

Although a weighted average of plural sensor values is obtained in the above-described embodiments, the control may also be performed by any method if the air conditioning control can be performed by taking plural sensor values into consideration.

The invention claimed is:

1. An air conditioning system comprising:

plural sensor units each having a sensor for detecting temperatures and/or humidities of space to be air-conditioned and outputting the temperatures and/or the humidities as sensor values, unit-identification setting means for generating identification information for identifying the corresponding sensor units, and first wireless transceiving means for modulating the identification information generated by the unit-identification setting means and the sensor values outputted by the sensors and transmitting the modulated identification information and sensor values; and an air conditioning unit having second wireless transceiving means for receiving the identification information and the sensor values from the first wireless transceiving means in the sensor units and demodulating the identification information and the sensor values, and controlling means for adjusting the temperatures and/or the humidities of the space to be air-conditioned, based on a weighted average value tinged with weight values, relating to the sensor values of the sensor units identified based on the identification information demodulated by the second wireless transceiving means, the sensor values being demodulated by the second wireless transceiving means, wherein at least one of the sensor units comprises a user controlled manual operation switch that is manipulated by a user to manually input information corresponding to user temperature sensation, the information corresponding to user temperature sensation being transmitted to the first wireless transceiving means and used to change a weight of the at least one of the sensor units.

2. An air conditioning system comprising:

plural sensor units each having a sensor for detecting temperatures and/or humidities of space to be air-conditioned and outputting the temperatures and/or the humidities as sensor values, unit-identification setting means for generating identification information for identifying the corresponding sensor units, and first wireless transceiving means for modulating the identification information generated by the unit-identification setting means and the sensor values outputted by the sensors and transmitting the modulated identification information and sensor values; and an air conditioning unit having second wireless transceiving means for receiving the identification information and the sensor values from the first wireless transceiving means in the sensor units and demodulating the identification information and the sensor values, and controlling means for adjusting the temperatures and/or the humidities of the space to be air-conditioned, based on a weighted average value tinged with weight values, relating to the sensor values of the sensor units identified based on the identification information demodulated by the second wireless transceiving means, the sensor values being demodulated by the second wireless transceiving means, wherein the air conditioning unit further comprises a louver, and the plural sensor units are arranged in respective divided areas obtained by dividing a room area based on blowout directions of the louver, and the controlling means included in the air conditioning unit computes a weighted average corresponding to the sensor values from at least one sensor unit in each of the divided areas and pre-held weight values corresponding to the sensors and performs control of the louver based on a result of the computation.

3. An air conditioning system comprising:

plural sensor units each having a sensor for detecting temperatures and/or humidities of space to be air-conditioned and outputting the temperatures and/or the humidities as sensor values, unit-identification setting means for generating identification information for identifying the corresponding sensor units, and first wireless transceiving means for modulating the identification information generated by the unit-identification setting means and the sensor values outputted by the sensors and transmitting the modulated identification information and sensor values;

an air conditioning unit having second wireless transceiving means for receiving the identification information and the sensor values from the first wireless transceiving means in the sensor units and demodulating the identification information and the sensor values, and controlling means for adjusting the temperatures and/or the humidities of the space to be air-conditioned, based on a weighted average value tinged with weight values, relating to the sensor values of the sensor units identified based on the identification information demodulated by the second wireless transceiving means, the sensor values being demodulated by the second wireless transceiving means;

a louver, and storing means for storing a table in which a direction of the louver, the sensor unit that exists in the direction, and a weight value thereof are associated with each other, wherein, each time the direction of the louver is changed, the controlling means reads out the table stored in the storing means to obtain the sensor unit that exists in the direction of the louver and the weight value thereof, and computes a weighted average based on temperature information obtained from the obtained sensor unit and the obtained weight value.

4. An air conditioning system comprising:

plural sensor units each having a sensor for detecting temperatures and/or humidities of space to be air-conditioned and outputting the temperatures and/or the humidities as sensor values, unit-identification setting means for generating identification information for identifying the corresponding sensor units, and first wireless transceiving means for modulating the identification information generated by the unit-identification setting means and the sensor values outputted by the sensors and transmitting the modulated identification information and sensor values;

an air conditioning unit having second wireless transceiving means for receiving the identification information and the sensor values from the first wireless transceiving means in the sensor units and demodulating the identification information and the sensor values, and controlling means for adjusting the temperatures and/or the humidities of the space to be air-conditioned, based on a weighted average value tinged with weight values, relating to the sensor values of the sensor units identified based on the identification information demodulated by the second wireless transceiving means, the sensor values being demodulated by the second wireless transceiving means; and a user-worn wireless transmitting device that transmits user position information to the controlling means, wherein the controlling means determines a sensor unit closest to the position of the user and calculates an increased weight for the sensor unit to enhance air conditioning at the position of the user by adjusting a blow-out direction of a louver corresponding to the sensor unit closest to the position of the user.

5. The air conditioning system according to claim 4, wherein the controlling means is further for enhancing air conditioning in advance by increasing the weights of sensor units in a predicted user movement direction based on recently stored user position and time information acquired from the user-worn transmitting device.

6. The air conditioning system according to claim 5, wherein the user-worn transmitting device comprises an RFID device.

7. The air conditioning system according to claim 6, further comprising a plurality of RFID readers positioned to track the RFID device, each of the plurality of RFID readers including a controller to generate and send RFID device time and position information to the controlling means to enable the controlling means to determine the predicted user movement direction.

8. The air conditioning system according to claim 4, wherein the user-worn transmitting device comprises an RFID device.

9. The air conditioning system according to claim 6, further comprising a plurality of RFID readers positioned to track the RFID device, each of the plurality of RFID readers including a controller to send RFID device time and position information to the controlling means to enable the controlling means to identify the sensor unit closest to the RFID device and to intensively adjust the weight of the sensor unit closest to the RFID device to enhance the air conditioning at the position of the user.

* * * * *